US008465611B2

(12) United States Patent
Farell et al.

(10) Patent No.: US 8,465,611 B2
(45) Date of Patent: Jun. 18, 2013

(54) AREA BONDED NONWOVEN FABRIC FROM SINGLE POLYMER SYSTEM

(75) Inventors: Gregory W. Farell, Hendersonville, TN (US); Edward Keith Willis, Goodlettsville, TN (US)

(73) Assignee: Fiberweb, Inc., Old Hickory, TN (US)

( * ) Notice: Subject to any disclaimer, the term of this patent is extended or adjusted under 35 U.S.C. 154(b) by 0 days.

(21) Appl. No.: 13/150,461

(22) Filed: Jun. 1, 2011

(65) Prior Publication Data

US 2011/0230110 A1 Sep. 22, 2011

Related U.S. Application Data

(62) Division of application No. 12/228,656, filed on Aug. 14, 2008, now Pat. No. 7,994,081.

(60) Provisional application No. 60/965,075, filed on Aug. 17, 2007.

(51) Int. Cl.
*D04H 3/14* (2012.01)
*D01F 8/04* (2006.01)

(52) U.S. Cl.
USPC ..... 156/167; 156/181; 264/172.12

(58) Field of Classification Search
USPC ..... 156/181, 167; 264/172.12, 172.17, 264/172.19
See application file for complete search history.

(56) References Cited

U.S. PATENT DOCUMENTS 3,304,220 A 2/1967 McIntyre
3,309,260 A 3/1967 Boese
3,384,944 A 5/1968 Medeiros et al.
3,502,538 A * 3/1970 Petersen ..... 428/359
3,989,788 A 11/1976 Estes, Jr. et al.
4,795,668 A 1/1989 Krueger et al.
4,869,958 A 9/1989 Murase et al.
5,082,720 A 1/1992 Hayes (Continued)

FOREIGN PATENT DOCUMENTS

EP 0 340 982 11/1989
EP 1 023 093 11/2003

(Continued)

OTHER PUBLICATIONS

Search Report and Written Opinion for PCT/US2008/073136 dated Nov. 19, 2008.

*Primary Examiner* — Michael Tolin
(74) *Attorney, Agent, or Firm* — Meunier Carlin & Curfman, LLC

(57) ABSTRACT

A nonwoven fabric is provided having a plurality of semi-crystalline filaments that are thermally bonded to each other and are formed of the same polymer and exhibit substantially the same melting temperature. The fabric is produced by melt spinning an amorphous crystallizable polymer to form two components having different levels of crystallinity. During spinning, a first component of the polymer is exposed to conditions that result in stress-induced crystallization such that the first polymer component is in a semi-crystalline state and serves as the matrix or strength component of the fabric. The second polymer component is not subjected to stress induced crystallization and thus remains in a substantially amorphous state which bonds well at relatively low temperatures. In a bonding step, the fabric is heated to soften and fuse the binder component. Under these conditions, the binder component undergoes thermal crystallization so that in the final product, both polymer components are semi-crystalline.

19 Claims, 13 Drawing Sheets
(1 of 13 Drawing Sheet(s) Filed in Color)

U.S. PATENT DOCUMENTS

| | | | | |
|---|---|---|---|---|
| 5,382,400 | A | 1/1995 | Pike et al. | |
| 5,387,382 | A | 2/1995 | Fottinger et al. | |
| 5,418,045 | A | 5/1995 | Pike et al. | |
| 5,562,930 | A | 10/1996 | Hills | |
| 5,716,568 | A * | 2/1998 | Kaegi et al. | 264/103 |
| 5,730,821 | A | 3/1998 | Joest et al. | |
| 6,165,217 | A | 12/2000 | Hayes | |
| 6,274,238 | B1 | 8/2001 | DeLucia | |
| 6,309,423 | B2 | 10/2001 | Hayes | |
| 6,548,431 | B1 | 4/2003 | Bansal et al. | |
| 6,589,892 | B1 | 7/2003 | Smith et al. | |
| 6,613,704 | B1 | 9/2003 | Arnold et al. | |
| 6,767,485 | B1 * | 7/2004 | Steiner | 264/40.1 |
| 6,770,356 | B2 | 8/2004 | O'Donnell et al. | |
| 6,811,873 | B2 | 11/2004 | Nadkarni | |
| 6,916,752 | B2 | 7/2005 | Berrigan et al. | |
| 6,964,931 | B2 | 11/2005 | Carlyle et al. | |
| 2001/0000352 | A1 | 4/2001 | Hayes | |
| 2002/0065013 | A1 | 5/2002 | Porterfield et al. | |
| 2002/0160682 | A1 | 10/2002 | Zeng et al. | |
| 2003/0119403 | A1 | 6/2003 | Willis et al. | |
| 2003/0124941 | A1 | 7/2003 | Hwo et al. | |
| 2003/0216099 | A1 | 11/2003 | Berrigan et al. | |
| 2004/0013877 | A1 * | 1/2004 | Nadkarni | 428/373 |
| 2004/0097158 | A1 | 5/2004 | Rudisill et al. | |
| 2005/0182233 | A1 | 8/2005 | Weinhold et al. | |
| 2007/0172630 | A1 * | 7/2007 | Jones et al. | 428/95 |

FOREIGN PATENT DOCUMENTS

| | | |
|---|---|---|
| EP | 1 016 741 | 1/2005 |
| JP | 01-321916 | 12/1989 |
| JP | 03069647 A | 3/1991 |
| JP | 2005105434 | 4/2005 |
| WO | WO 03/100141 | 12/2003 |
| WO | WO 2008/016770 | 2/2008 |

* cited by examiner

AREA BONDED NONWOVEN FABRIC FROM SINGLE POLYMER SYSTEM

CROSS REFERENCE TO RELATED APPLICATION

This application is a divisional of application Ser. No. 12/228,656, filed Aug. 14, 2008, now U.S. Pat. No. 7,994,081, which is based on Provisional Application Ser. No. 60/965,075, filed Aug. 17, 2007, incorporated herein by reference in its entirety, and claims the benefit of its earlier filing date under 35 U.S.C. 119(e).

FIELD OF THE INVENTION

The present invention relates generally to nonwoven fabrics, and more particularly to nonwoven fabrics formed from polymers that undergo stress-induced crystallization.

BACKGROUND OF THE INVENTION

Nonwoven fabrics formed from fibers that are thermally bonded to each other have been produced for many years. Two common thermal bonding techniques include area bonding and point bonding. In area bonding, bonds are produced throughout the entire nonwoven fabric at locations where the fibers of the nonwoven fabric come into contact with one another. This can be achieved in various ways, such as by passing heated air, steam or other gas through an unbonded web of fibers to cause the fibers to melt and fuse to one another at points of contact. Area bonding can also be achieved by passing a web of fibers through a calender composed of two smooth steel rollers heated to cause the fibers to soften and fuse. In point bonding, the web of fibers is passed through a heated calender nip comprised of two nip rolls, wherein at least one of the rolls has a surface with a pattern of protrusions. Typically, one of the heated rolls is a patterned roll and the cooperating roll has a smooth surface. As the web moves through the calender roll, the individual fibers are thermally bonded together at discrete locations or bond sites where the fibers contact the protrusions of the patterned roll and the fibers are unbonded in the locations between these point bond sites.

Point bonding can be used effectively to bond nonwoven fabrics formed from thermoplastic fibers having the same polymer composition and similar melting temperature. However, area bonding is not ordinarily usable for nonwoven fabrics of this type since the fabrics typically require the presence of a binder component that softens and melts at a temperature lower than that of the fibers in order to produce the bonds.

One example of a well known commercially available area bonded nonwoven fabric is sold under the registered trademark Reemay® by Fiberweb Inc. of Old Hickory, Tenn. This spunbond fabric is produced generally in accordance with the teachings of U.S. Pat. Nos. 3,384,944 and 3,989,788 in which filaments of a higher melting polymer composition and a lower melting polymer composition are intermingled with each other and deposited onto a moving belt to form a web. The web of filaments is directed through a hot air bonder, where the filaments of the lower melting composition soften and melt to form bonds throughout the web, resulting in a nonwoven fabric with desirable physical properties. The filaments composed of the higher melting polymer composition do not melt during bonding and provide strength to the fabric. For example, in the Reemay® fabric, the higher melting composition is a polyester homopolymer and the lower melting binder composition is a polyester copolymer.

The requirement of using two separate polymer compositions increases the handling and processing requirements of the manufacturing process and makes it difficult to recycle or reuse scrap or waste material due to the presence to two different polymer compositions. Additionally, the melting temperature of the lower melting composition represents a limitation on the temperature conditions under which the nonwoven fabric can be used.

BRIEF SUMMARY OF THE INVENTION

The present invention pertains to nonwoven fabric produced from a single polymer system. In particular, the present invention uses a semi-crystalline polymer resin system that undergoes stress-induced crystallization in the fiber spinning process. According to the present invention, the semi-crystalline polymer resin produces predominately amorphous fibers for bonding in the nonwoven fabric and semi-crystalline fibers for fabric strength. An area bonded nonwoven fabric is provided in which a plurality of semi-crystalline fibers are thermally bonded to each other and are formed of substantially the same polymer composition.

Polymer intrinsic viscosity (IV), polymer throughput, spinning speed, melt temperatures, quench temperatures and flowrates are among the process variables that impact spinline stress and which can be utilized to provide the desired level of crystallinity in the fibers of a nonwoven fabric. A crystallizable polymer in the uncrystallized or amorphous state can effectively form thermal bonds at relatively low temperatures, but after crystallization it is more difficult to thermally bond. The present invention makes use of these process variables to produce both the semi-crystalline fiber for fabric strength and the amorphous fiber for thermal bonding. After thermal bonding, both fibers are present in the fabric in semi-crystalline or substantially crystalline state.

In one aspect, the present invention provides a method of making a nonwoven fabric in which a crystallizable polymer is melt extruded to produce a plurality of fibers and the polymer is subjected to processing conditions such that a first polymer component is produced which is at least partially crystalline and a second polymer component is produced that is substantially amorphous. The first polymer component is in a semi-crystalline state and comprises the matrix component of the fabric. The second component of the polymer does not undergo any substantial crystallization and as a result remains in a substantially amorphous state. The second polymer component has a softening point that is lower than that of the first polymer component and therefore the second polymer component serves as the binder component for the fabric.

The fibers are deposited on a collection surface to form a web containing both the partially crystalline first polymer component and the amorphous second polymer component. The fibers are then thermally bonded to one another to form a bonded nonwoven web in which the amorphous second polymer component softens and fuses to form bonds with the first polymer component. During the bonding process, heat causes the binder to become tacky and fuse with itself and the matrix component of adjacent fibers at points of contact. Bonding also effects crystallization of the second polymer component so that in the resulting bonded nonwoven fabric both of the polymer components are at least partially crystalline.

In one embodiment, continuous filaments of the same polymer composition are melt extruded and processed under conditions to produce first and second components of the polymer having different levels of crystallinity. For example, during extrusion, a first component of the polymer is exposed to spinning conditions that result in stress-induced crystallization in the first polymer component, whereas a second polymer component is subjected to stress that is insufficient to induce substantial crystallization. The amount of stress to which the polymer components are exposed can be manipulated using various process variables to impart a desired level of crystallinity in the fibers. Such process variables include polymer intrinsic viscosity (IV), polymer throughput, spinning speed, melt temperatures, quench temperatures, flow rates, draw ratios, and the like.

In one embodiment, the present invention provides a spunbond nonwoven web that is composed of separate matrix and binder filaments comprising polyethylene terephthalate (PET) homopolymer. The matrix filaments have a higher intrinsic viscosity (IV) than the binder filaments and are melt extruded under conditions that result in the matrix filaments having more crystallinity than the binder filaments. In some embodiments, the binder filaments may have a softening temperature that is about 10° C. below the softening temperature of the matrix filaments. The filaments are then area bonded to bond the filaments to one another at points of contact. After thermal bonding, both the matrix and binder filaments are in a semi-crystalline state and generally exhibit a single melting peak as evidenced by a DSC trace. In one embodiment, the matrix filaments are formed with PET homopolymer having an intrinsic viscosity of about 0.65 dl/g or greater, such as 0.68 dl/g, and the binder filaments are formed with PET homopolymer having an intrinsic viscosity of about 0.62 dl/g or less, such as 0.61 dl/g.

In a further embodiment, the present invention is directed to a nonwoven fabric composed of bicomponent filaments that are sheath/core or tipped multilobal filaments. The sheath or tips comprise the binder component of the filaments, while the core comprises the matrix component. In one embodiment, the bicomponent filaments comprise PET homopolymer having low and high intrinsic viscosity (IV) components that correspond to the binder and matrix components, respectively. The bicomponent filaments are spun at speeds in which the higher IV polymer component is crystallized by stress-induced crystallization to serve as the matrix component and the lower IV polymer component remains in a substantially amorphous state to serve as the binder component. In one particular embodiment, the bicomponent filaments contain between 5 and 20% by weight of the lower IV component and between 80 and 95% by weight of the higher IV component.

In another aspect, recycled PET can serve as the binder resin. The IV of the recycled PET is adjusted to about 0.62 or less in order to be used as the binder fibers. An additive can be used to break the PET chain in the recycled polymer material to reduce the IV of the recycled polymer. In this embodiment, the fibers can comprise separate matrix and binder or multicomponent fibers.

Nonwoven webs in accordance with the invention can be prepared from a variety of amorphous polymer compositions that are capable of undergoing stress induced crystallization, such as nylons and polyesters including polyethylene terephthalate (PET), polylactic acid (PLA), polytrimethylene terephthalate (PTT), and polybutylene terephthalate (PBT).

BRIEF DESCRIPTION OF THE SEVERAL VIEWS OF THE DRAWING(S)

The patent or application file contains at least one drawing executed in color. Copies of this patent or patent application publication with color drawing(s) will be provided by the Office upon request and payment of the necessary fee.

Having thus described the invention in general terms, reference will now be made to the accompanying drawings, which are not necessarily drawn to scale, and wherein:

Figure 15A:
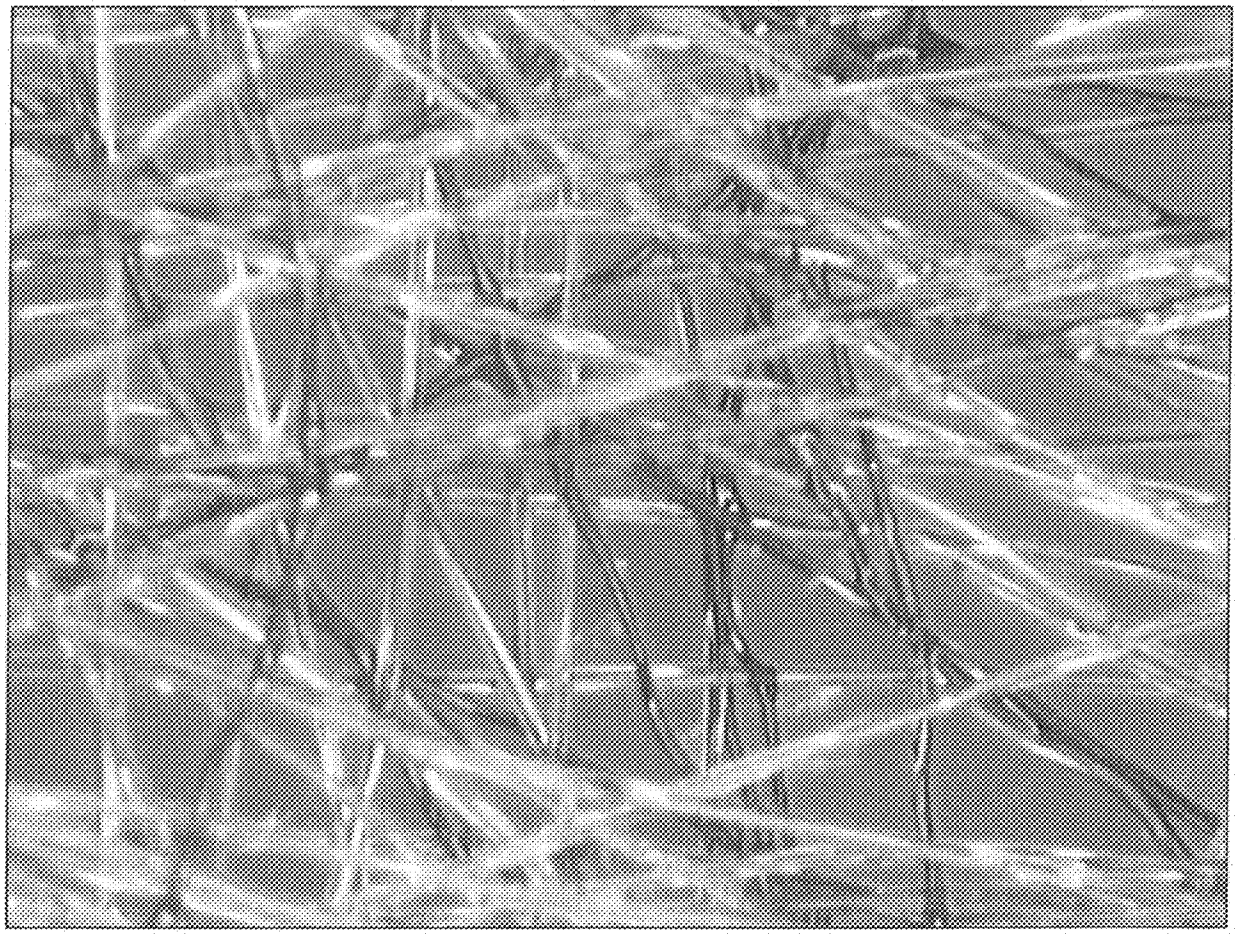
Figure 15B:
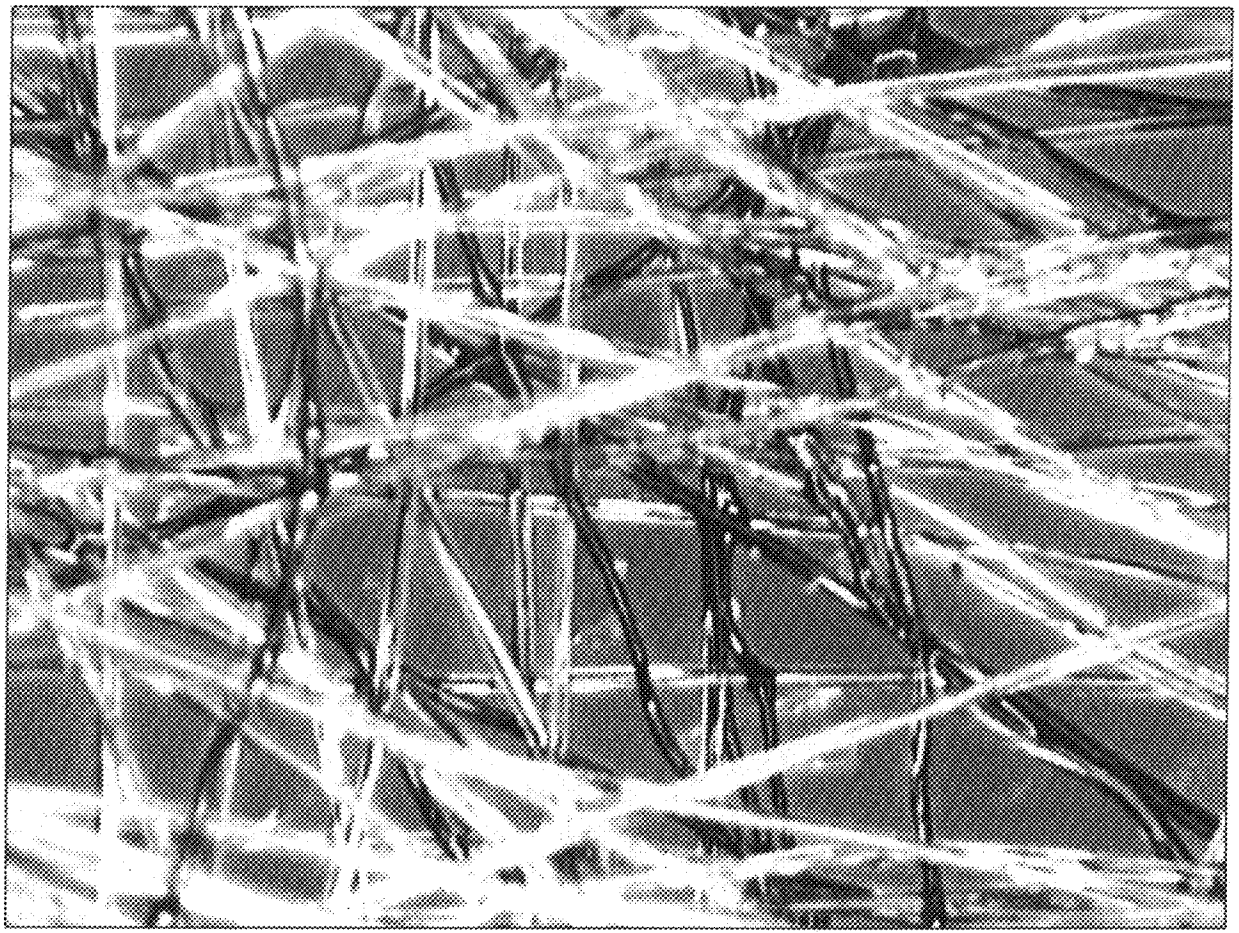

FIG. 15A is a color photomicrograph a nonwoven fabric composed of matrix and binder homofilaments that have been thermally bonded to each other, and wherein the fabric has been stained with a dye to reveal the differing levels of orientation in the matrix and binder filaments; and FIG. 15B is the photomicrograph of FIG. 15A in gray-scale in which a nonwoven fabric composed of matrix and binder homofilaments that have been thermally bonded to each other, and wherein the fabric has been stained with a dye to reveal the differing levels of orientation in the matrix and binder filaments.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention is directed to a nonwoven fabric that is formed by melt extruding a crystallizable amorphous thermoplastic polymer to produce a plurality of fibers. The fibers are deposited on a collection surface to form a web, and the fibers are bonded to one another to form a strong coherent nonwoven fabric. The crystallizable amorphous thermoplastic polymer used for producing the fibers is capable of undergoing stress induced crystallization. During processing, a first component of the polymer composition is subjected to process conditions that result in stress induced crystallization such that the first polymer component is in a semi-crystalline state. A second component of the polymer is processed under conditions that are insufficient to induce crystallization and therefore the second polymer component remains substantially amorphous. Due to its amorphous nature, the second polymer component has a softening temperature below that of the semi-crystalline first polymer component and is thus capable of forming thermal bonds at temperatures below the softening temperature of the first polymer component. Thus, the amorphous second polymer component can be utilized as a binder component of the nonwoven fabric while the semi-crystalline first polymer component can serve as the matrix component of the nonwoven fabric providing the requisite strength physical properties of the fabric such as tensile and tear strength.

By "amorphous", it is meant that the degree of crystallinity in the second polymer component is less than that which is desired for the first polymer component, and is sufficiently low so that the second polymer has a softening temperature below the softening temperature of the first polymer component. The term "softening temperature" generally refers to the temperature or temperature range at which the polymer component softens and becomes tacky. The softening temperature of the first and second polymer components can be readily determined by industry standard test methods e.g., ASTM D1525-98 Standard Test Method for Vicat Softening Temperature of Plastics, and ISO 306: 1994 Plastic-Thermoplastic materials—determination of Vicat softening temperature. The softening temperature of the second polymer component is desirably at least 5° C. below that of the first polymer component, with a softening temperature difference between 5 and 30° C. being preferred, and with a difference of between 8 to 20° C. being typical. In one particular embodiment, the softening temperature of the second polymer component is about 10° C. below that of the first polymer component. The difference in the softening temperature allows the second polymer component to be rendered tacky and to form thermal bonds at temperatures below the temperature at which the first polymer component would begin to soften and become tacky.

During a bonding step, the web of unbonded fibers is heated to the point that the amorphous binder component softens and fuses with itself and with the matrix component of adjacent fibers at points of contact to form a strong coherent nonwoven fabric. During bonding, the binder component also typically undergoes thermal crystallization so that in the resulting bonded nonwoven fabric both matrix and binder components are at least partially crystalline. Typically, the bonding conditions allow for substantially complete crystallization of both the matrix fibers and the binder fibers. As a result, a differential scanning calorimetry (DSC) curve of the bonded fabric reveals only a single peak corresponding to the latent heat of melting of the crystalline regions in the matrix and binder fibers. This is in distinct contrast to what is observed in conventional area bonded fabrics that rely upon a lower-melting temperature binder composition for bonding.

The nonwoven fabric of the present invention is thus distinguishable from area bonded nonwovens produced by known processes of the prior art in that the nonwoven of the invention is area bonded, yet consists of only one polymer system from which both the strength or matrix fibers and the binder fibers of the nonwoven fabric are formed. One advantage of using a single polymer system to form both the binder and matrix components is an improvement in both the cost and efficiency. In contrast to some prior art nonwovens, there is no need to use an additional binder resin having a different polymer chemistry than the matrix resin. Generally, conventional binder resins may require the presence of additional extrusion equipment, transfer lines, and the like. As a result, the costs associated with such nonwovens may be greater. In the present invention, utilizing a single polymer system can help reduce these costs and inefficiencies. In the case of bicomponent fibers, the use of a single polymer system may also result in the binder component being more evenly distributed throughout the web because the matrix and binder components are distributed along the same fiber.

While both the matrix and binder fibers are at least partially crystalline in the final bonded fabric, they have different morphology and molecular orientation. The matrix fibers were crystallized under stress, whereas the binder fibers were thermally crystallized without stress. Dyeing the fibers with common dyes allows one to observe the two distinct types of fibers. Dye uptake is very sensitive to molecular orientation, crystallinity and morphology. The two types of fibers exhibit different dye uptakes. The binder fibers have lower levels of preferential molecular orientation and take dye more readily than the matrix fibers. One suitable way of observing the differences in the two types of fibers is to take a nonwoven fabric produced according to the present invention which has been bonded and heat set to fully crystallize both the binder and the matrix fibers and to reduce the nonwoven fabric shrinkage and to stain the nonwoven fabric using dyestuffs suitable for the particular polymer composition. For example, PET fibers can be suitably stained using dyes such as Terasil Blue GLF (Ciba Specialty Chemicals) in boiling water. Inspection of the resulting fabric with the naked eye or by microscopy will show the binder fibers stained darker than the matrix fibers, as can be seen in FIGS. 15A and 15B.

Polymer compositions that may be used in the accordance with the invention generally include polymers that are capable of undergoing stress induced crystallization and are relatively amorphous when melted. Suitable polymer compositions may include polyesters and polyamides such as nylons. Exemplary polyesters may include polyethylene terephthalate (PET), polytrimethylene terphthalate (PTT), polybutylene terephthalate (PBT), and polylactic acid (PLA), and copolymers, and combinations thereof.

The present invention can be used to prepare a variety of different nonwoven fabrics including spunbond nonwoven fabrics, melt blown fabrics, combinations thereof, and the like. The present invention can also be used to form a variety of different fibers including short fibers, continuous filaments, and multicomponent fibers. Unless otherwise stated, the term "fiber" is used generically to refer to both discrete length short fibers and continuous filaments.

As discussed above, the fibers comprising the first and second polymer components can be produced by melt extruding a relatively amorphous molten polymer composition under process conditions that induce orientation, and hence crystallization in one of the components, while the second component remains primarily amorphous. Methods of inducing and controlling the degree of crystallization include parameters such as spinning speed, spinning and drawing temperatures, quenching conditions, draw ratios, intrinsic viscosity of the melt stream, polymer throughput, melt temperatures, flow rates, and combinations thereof.

For example, during the extrusion process, a first group of continuous filaments can be extruded and attenuated under a first set of conditions which result in stress-induced crystallization and the same polymer composition can be used to produce a second group of continuous filaments which are extruded and attenuated under a second set of conditions which do not result in stress-induced crystallization and induce minimal or no crystallization in the filaments. The differing conditions can include one or more of the following variables: polymer throughput, rate of quench air, draw ratio (for mechanically drawn filaments), air pressure (for pneumatically attenuated filaments). Subjecting the polymer melt stream to stress imparts orientation to the amorphous polymer, and thereby causes stress-induced crystallinity in the filaments. Generally, polymer compositions such as polyester remain in a relatively amorphous state when spun at low speeds. At higher extrusion rates, the amount of stress in the polymer increases, which results in increases in the crystallinity of the polymer. For example, relatively high speed spinning causes high stress in the molten fibers which results in orientation and crystallization of the polymer molecules. The spinning speed used is generally dependent on the desired properties of the resulting fabric, polymer properties, such as intrinsic viscosity and energy generated in forming crystals, and other processing conditions such as the temperature of the molten polymer used, capillary flow rate, melt and quench air temperatures, and drawing conditions. In one embodiment, the fibers are spun at moderate to high spinning speeds in order to induce the desired level of crystallinity. Accordingly, the desired amount of crystallinity in the fibers is an important parameter in determining the process conditions under which crystallization is induced in the first polymer component.

Additionally, fibers may be spun at lower speeds and then mechanically drawn at draw ratios that subject the molten fibers to stress levels needed to induce orientation and crystallization. The conditions necessary to induce crystallization may also vary with the physical properties of the polymer itself, such as the intrinsic viscosity of the polymer melt. For instance, a polymer having a higher intrinsic viscosity will experience more stress at a spinning speed or draw rate than a polymer having a lower intrinsic viscosity that is processed under similar conditions.

In one preferred embodiment, the first and second polymer components can be formed by selecting two polymer compositions that are the same as each other, i.e. the same polymer, but differing in intrinsic viscosity or in molecular weight with respect to each other. At a given extrusion rate, the polymer composition having the higher intrinsic viscosity will experience more stress than that experienced by the polymer composition having a lower intrinsic viscosity. As a result, the polymer composition for the first and second polymer components can be selected based on intrinsic viscosity. Differences in intrinsic viscosity between the first and second polymer components can be achieved in several ways. For example, many resin manufacturers offer different grades of the same polymer, and two different grades of the same polymer can be selected which differ in the intrinsic viscosity. Differences in the intrinsic viscosity can also be achieved by the addition of one or more additives that alters the intrinsic viscosity or molecular weight of the polymer. Examples of such additives include ethylene glycol, propylene glycol, magnesium stearate, and water.

In one embodiment, the first and second polymer components are formed from two separate polymer compositions comprising polyethylene terephthalate in which the polymer compositions have a difference in intrinsic viscosity that is at least 0.15. In one particular embodiment, the matrix component is formed with PET homopolymer having an intrinsic viscosity of 0.68 dl/g or greater, and the binder component is formed with PET homopolymer having an intrinsic viscosity of 0.61 dl/g or less.

Figure 1:
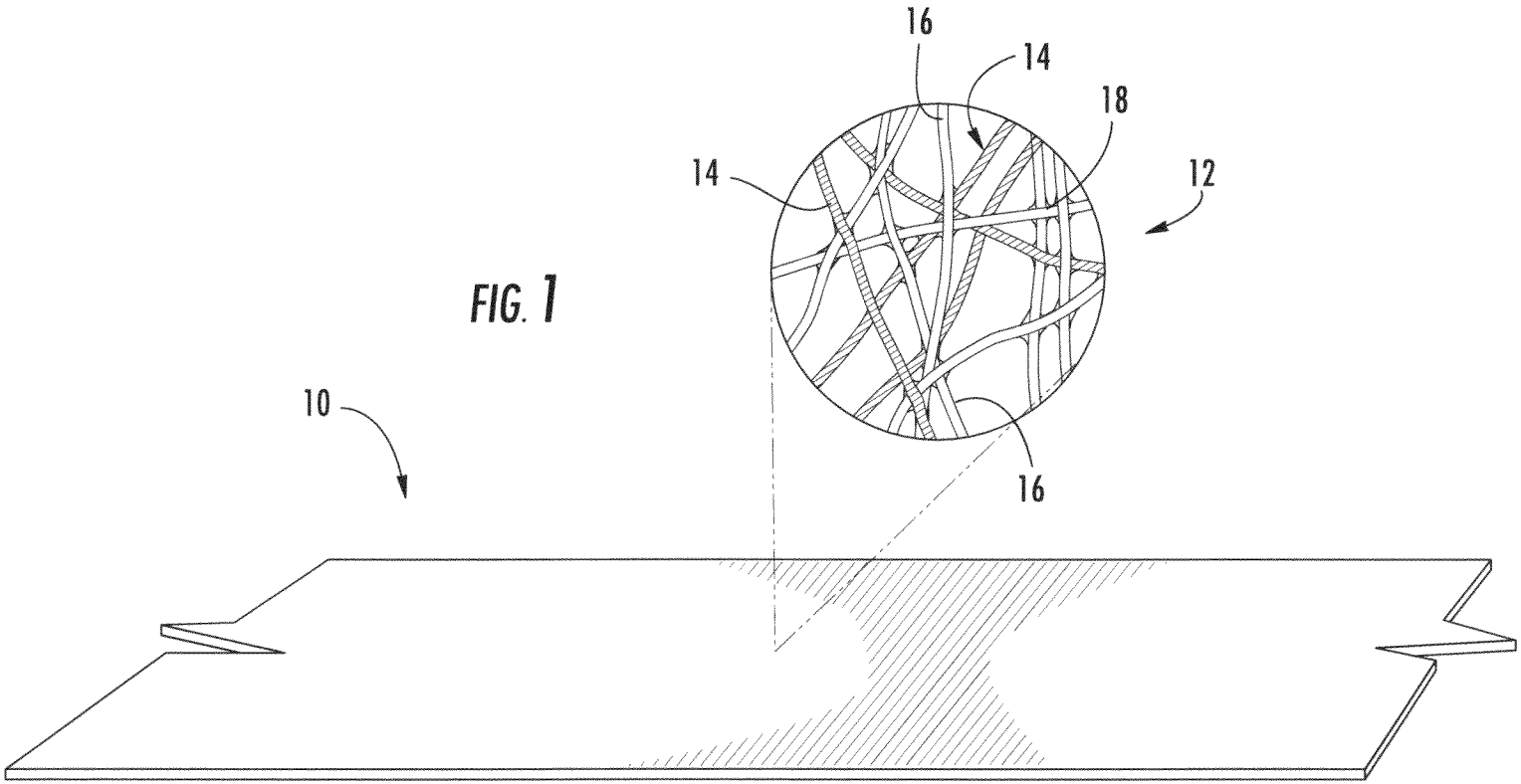
FIG. 1 is a perspective view of a spunbond nonwoven fabric comprising continuous filaments that are at least partially crystalline and continuous filaments that are amorphous in nature.

In one particularly useful embodiment, the present invention provides a spunbond nonwoven fabric formed from continuous filaments comprising the first polymeric component (i.e., matrix component or matrix fibers) and continuous filaments comprising the second polymeric component (i.e., binder component or binder fibers) that are thermally bonded to one another to produce a strong and coherent web. In this regard, FIG. 1 illustrates an embodiment of the invention in which an area bonded spunbond nonwoven fabric 10 is formed of continuous filaments 14 comprising the first polymer component and continuous filaments 16 of the second polymer component that are bonded to one another. In this embodiment, filaments 14, 16 are produced by melt extruding the polymer through one or more spinnerets to form first and second groups of continuous filaments. The first and second groups of filaments are then subjected to processing conditions in which the first group of continuous filaments is subjected to stress that induces crystallization, and the second group of continuous filaments is subjected to stress that is insufficient to induce crystallization. As a result, the polymer from which filaments 14 are formed is at least partially crystallized, and the polymer of filaments 16 remains in a substantially amorphous state.

Application of sufficient heat to a web comprising filaments 14, 16 having the first and second polymer components causes filaments 16 to soften and fuse with filaments 14 at points of contact so that the filaments become bonded to one another to form a strong and coherent web.

FIG. 1 also includes a magnified section 12 of the fabric and depicts individual filaments 14, 16 bonded to one another. As shown, the nonwoven fabric 10 comprises homofilaments 14 that are at least partially crystalline (i.e., first polymer component), and homofilaments 16, that are primarily amorphous in nature (i.e., second polymer component). Thermal bonds 18 between the filaments 14, 16 occur at the points where the amorphous filaments intersect with each other and with the at least partially crystalline filaments. Although FIG. 1 depicts filaments 14, 16 as being distinct, it should be recognized that upon thermal bonding the first and second components of filaments 14, 16, respectively, are typically both in an a partially crystalline state.

In one embodiment, the spunbond nonwoven fabric depicted in FIG. 1 comprises from about 65 to 95%, and more preferably between 80 and 90% of filaments formed from the first polymer component, and from about 5 to 35%, and more preferably between 5 and 20% of the filaments comprised of the second polymer component.

Figure 2:
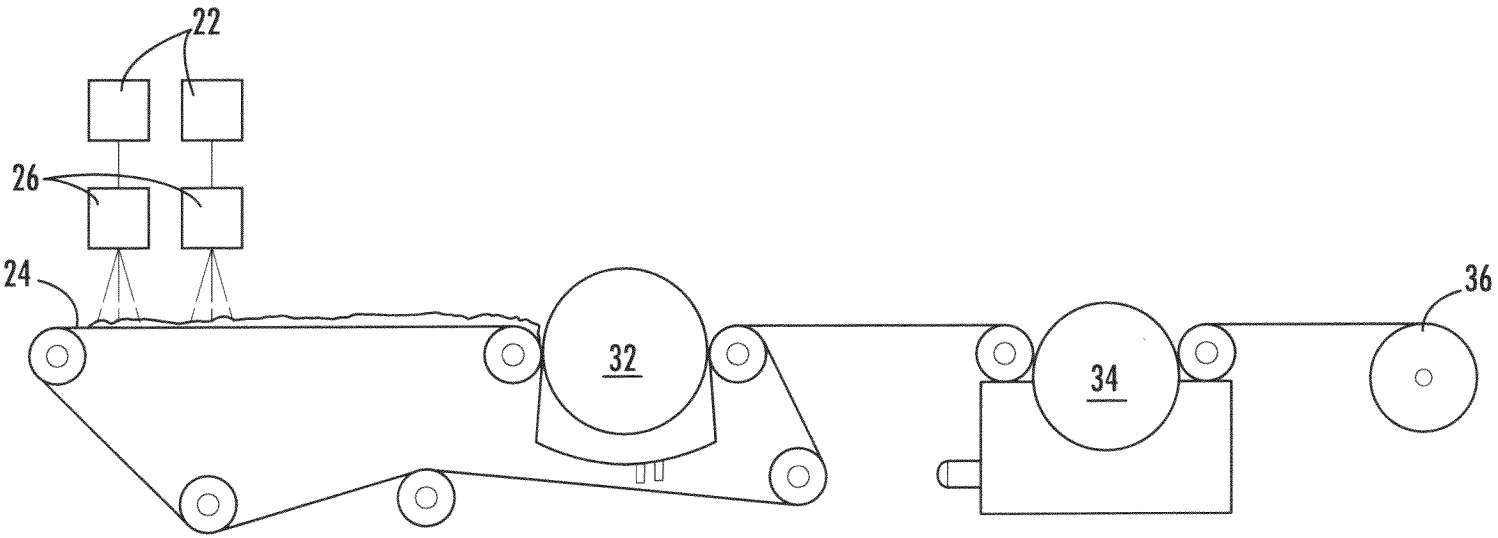
FIG. 2 is a schematic illustration of an apparatus for producing nonwoven fabrics according to one embodiment of the present invention.

FIG. 2 schematically illustrates an arrangement of apparatus for producing a spunbond nonwoven fabric in accordance with one embodiment of the present invention. The apparatus includes first and second successively arranged spin beams 22 mounted above an endless moving conveyor belt 24. While the illustrated apparatus has two spin beams, it will be understood that other configurations of apparatus with only one spin beam or with three or more spin beams could be employed. Each beam extends widthwise in the cross-machine direction, and the respective beams are successively arranged in the machine direction. Each beam is supplied with molten crystallizable polymer from one or more extruders (not shown). Spinnerets with orifices configured for producing continuous filaments are mounted to each of the spin beams 22. In one illustrative embodiment, two separate grades of the same polymer composition are used, with the polymer differing only in its intrinsic viscosity. The higher IV grade polymer is fed to one or more of the spin beams for forming matrix filaments and the lower IV grade polymer is fed to a second spin beam for forming binder filaments.

The freshly extruded filaments are cooled and solidified by contact with a flow of quench air, and the filaments are then attenuated and drawn, either mechanically by draw rolls, or pneumatically by attenuator devices 26. The spinline stress imparted to the filaments by the draw rolls or attenuator devices 26 causes stress-induced crystallization in the higher IV grade polymer that forms the matrix filaments, while the lower IV grade polymer that forms the binder filaments experience little or no stress-induced crystallization and remain substantially amorphous.

The filaments are then deposited randomly onto the advancing belt 24 to form a web. The filaments are then thermally bonded to give the web coherency and strength. Area bonding is particularly useful technique for bonding the web. Area bonding typically involves passing the web through a heated calender composed of two smooth steel rollers or passing heated steam, air or other gas through the web to cause the filaments comprising the second polymer component to become tacky and fuse to one another.

In the illustrated embodiment, the web of unbonded filaments is depicted as being directed through a steam consolidator 32, an example of which is generally shown in Estes et al. U.S. Pat. No. 3,989,788. The web is contacted with saturated steam, which serves to soften the binder fibers. The web is then transferred to a hot air bonder 34. The temperatures used in the bonding operation are considerably higher than those used in the consolidator, the temperature selected being dependent upon the tack temperature of the binder fibers and the properties desired in the product (e.g., strength, dimensional stability or stiffness). For fibers comprising polyethylene terephthalate, the consolidated web is typically exposed to air at 140 to 250° C., preferably 215 to 250° C. during bonding. During the consolidation and bonding steps, the binder fibers soften and become tacky, producing fusion bonds where the filaments cross one another. The resulting nonwoven fabric is an area bonded nonwoven, with bond sites uniformly distributed throughout the area and the thickness of the fabric. The bond sites provide the necessary sheet properties such as tear strength and tensile strength. The bonded web passes over exit roll to a windup device 36.

Generally, area bonding of the nonwoven web results in both the first polymer component and second polymer component being in at least a partially crystalline state, such that the semi-crystalline polymer has a degree of crystallinity that is at least 70% of its maximum achievable crystallinity. In one embodiment, area bonding results in the first and second polymer components having a degree of crystallinity that is at least 90% of its maximum achievable crystallinity, such as at least 99% of its maximum achievable crystallinity. Other area bonding techniques that may be used include ultrasonic bonding, RF bonding, and the like.

In yet another aspect of the invention, a spunbond nonwoven fabric can be formed from continuous bicomponent filaments in which the first and second polymer components are present in distinct portions of the cross section of the filaments. The term "bicomponent filaments" refers to filaments in which the first and second components are present in distinct portions of the filament cross section and extend substantially continuously along the length of the filaments. In one embodiment, the cross-section of the bicomponent fibers include a distinct region comprising the first polymer component that has been subjected to conditions that induce crystallization, and a second distinct region in which the second polymer component remains primarily in an amorphous state. The cross-sectional configuration of such a bicomponent filament may be, for example, a sheath/core arrangement wherein one polymer is surrounded by another, a side-by-side arrangement or a multilobal configuration.

In this embodiment, the first and second components can be produced by providing two streams of a molten amorphous polymer in which the polymer from which the second polymer component is formed has a lower intrinsic viscosity than the polymer of the first polymer component. During extrusion, the streams are combined to form a multicomponent fiber. The combined molten streams are then subjected to stress that induces crystallization in the higher intrinsic viscosity polymer and is insufficient to induce crystallization in the lower intrinsic viscosity polymer to thereby produce the first and second polymer components, respectively.

Figure 3:
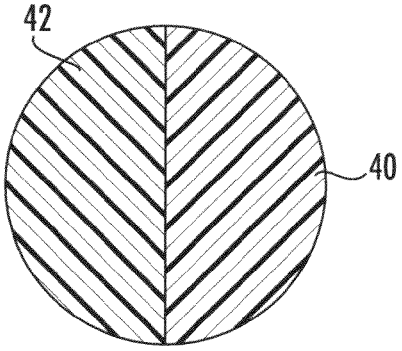
FIG. 3 illustrates a bicomponent filament cross-section having a first component that is at least partially crystalline and second component that is amorphous in nature and wherein the first and second components are present in distinct portions of the cross-section of the filament.
Figure 4:
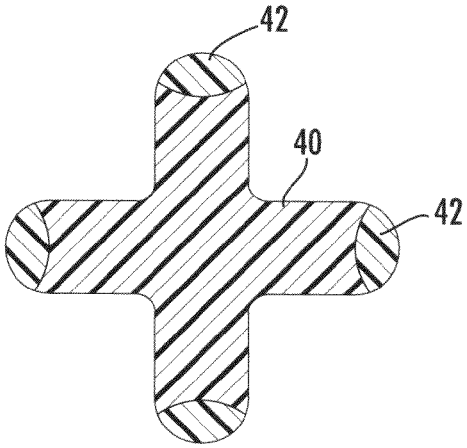
FIG. 4 illustrates a multilobal bicomoponent filament having the first and second components present in distinct portions of the cross-section of the filament.
Figure 5:
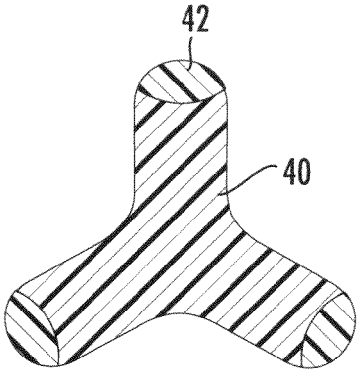
FIG. 5 illustrates a trilobal bicomoponent filament having the first and second components present in distinct portions of the cross-section of the filament.

FIGS. 3 through 5 illustrate embodiments of the invention wherein the first polymer component 40 (matrix component) comprises a portion of the cross-section of the fiber and the second polymer component 42 (binder component) comprises another portion of the cross-section of the fiber. Bicomponent fibers in accordance with the invention can be prepared using the apparatus and method described above in connection with FIG. 2 in which the spinnerets are designed for producing a bicomponent filament of the desired cross-sectional configuration. Suitable spinnerets are commercially available from various sources. One type of spinneret for forming bicomponent filaments is described in Hills U.S. Pat. No. 5,562,930. The spinnerets can be configured to form bicomponent filaments at all of the spinneret orifices, or alternatively, depending upon the particular product characteristics desired, the spinnerets can be configured to produce some bicomponent multilobal filament and some multilobal filaments formed entirely of one of the first and second polymer components. Methods of producing bicomponent filaments are discussed in greater detail in U.S. Patent Publication No. 2003/0119403, the contents of which are incorporated by reference.

FIG. 3 illustrates a bicomponent filament wherein the first and second polymer components are arranged in a side-by-side configuration. FIGS. 4 and 5 illustrate bicomponent filaments in which the bicomponent filaments have a modified cross-section defining multiple lobes. In these embodiments, it is important that the binder component be present on at least a portion of the surface of the filament, and desirably, the binder component should be located in at least one of the lobes of the multilobal filament cross-section. Most preferably, the binder component is located at the tip of one or more of the lobes. In one embodiment, the binder component comprises from about 2 to about 25 percent by weight of the filament, and preferably from about 5 and 15 percent by weight of the filament.

FIG. 4 illustrates a solid multilobal filament cross-section wherein the filament has four lobes. The matrix component 40 (first polymer component) occupies the central portion of the filament cross-section, and the binder component 42 occupies the tip portion of each lobe. In an alternate embodiment, the binder component can occupy the tip portion of only a single lobe, or the tips of two or three of the lobes. FIG. 5 illustrates a solid trilobal filament cross-section wherein the binder component 42 occupies the tip portion of each lobe. In an alternate form, the binder component 42 can occupy only one or two of the three lobes.

In yet another aspect, the present invention provides nonwoven fabrics in which one of the first or second polymer components comprises meltblown fibers and the other polymer component comprises spunbond continuous filaments. The term "meltblown fibers" means fibers formed by extruding a molten thermoplastic material through a plurality of fine, usually circular, die capillaries as molten threads or filaments into converging high velocity heated gas (e.g., air) streams which breaks the filaments into short fibers. In some embodiments, the high velocity gas can be used to attenuate the filaments to reduce their diameter, which may result in fibers having a microfiber diameter. Thereafter, the meltblown fibers are carried by the high velocity gas stream and are deposited on a collecting surface to form a web of randomly dispersed meltblown fibers.

Figure 6:
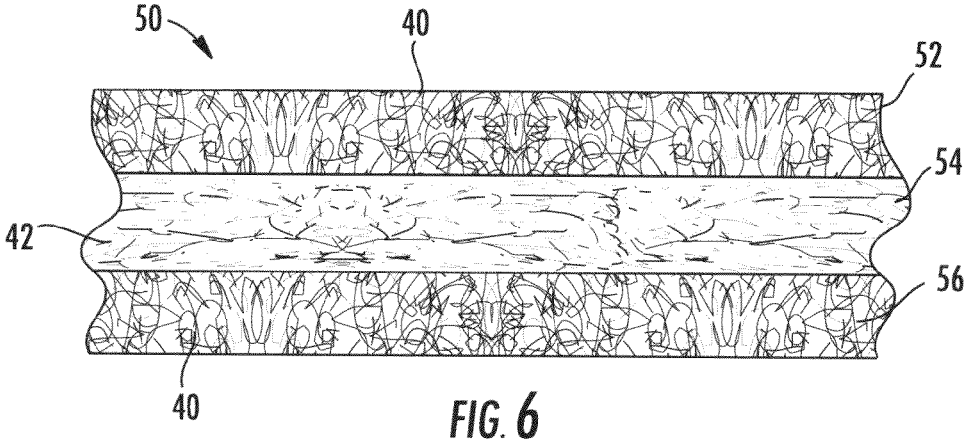
FIG. 6 is a cross-sectional side view of a composite nonwoven fabric having a spunbond/meltblown/spunbond construction that is in accordance with one embodiment of the present invention.

FIG. 6 illustrates a composite nonwoven fabric 50 having a spunbond/meltblown/spunbond construction including an inner layer 52 of meltblown fibers that is sandwiched between a pair of spunbond outer layers 54. In one embodiment, outer layers 54 are formed of continuous filaments that are at least partially crystalline and serve as matrix fibers in the nonwoven fabric, and inner layer 52 is formed of meltblown fibers that are primarily amorphous in nature. The meltblown fibers have a lower tack temperature than the continuous filaments and serve as binder fibers that have flowed and fused the fibers and filaments to each other to form a strong and coherent fabric.

Referring again to FIG. 2, in an alternative embodiment of the present invention, the filaments can be produced from the same identical polymer composition, but can be subjected to processing conditions that yield one group of filaments that undergo stress-induced crystallization and another group of filaments that remain substantially amorphous. For example, one or more of the spin beams can yield filaments that experience stress-induced crystallization as a result of the polymer throughput and/or draw ratio or attenuator settings. Filaments from another spin beam can be subjected to conditions, e.g. polymer throughput and/or draw ratio or attenuation, that results in the filaments having little or no stress-induced crystallization.

The principal and most preferred way for achieving the differing crystallinity and softening temperatures in the filaments is by slightly altering the polymer intrinsic viscosity of the two polymer components. This can be achieved, for example, by selecting two different grades of the same polymer composition, which differ only in the polymer intrinsic viscosity. It is also possible to lower the intrinsic viscosity of the polymer composition so that it can be used as the lower IV binder-forming component. For example additives can be used to break some of the polymer chains to lower IV and/or recycled polymer can be used as part or all of the lower IV component. For example, recycled PET can be used as the lower IV binder-forming polymer component. The IV of the recycled PET can be adjusted to 0.62 dl/g or lower in order to allow it to be used as the binder component. It is also possible to achieve differing crystallinity in the two polymer components through the use of additives that alter the spinline stress. Differences in the crystallinity can be obtained by incorporating minor amounts of additives or polymers that will lower the spinline stress, hence delaying crystallization. For example, a very low IV PTT can be added to PET in small amounts to lower the spinline stress and delay crystallization. Alternatively, ethylene glycol, fatty acids or other compatible additives can be added to PET to lubricate or plasticize the resin as it is extruded and thus reduce the spinline stress.

It should also be recognized that the first and/or second components may also include additives of the type that are conventionally found in meltspun polymer fibers, such dyes, pigments, plasticizers, optical brighteners, fillers, etc.

Nonwoven fabrics in accordance with the invention can be used in a wide variety of different applications, such as garments, dryer sheets, towels, and the like. In some embodiments, nonwoven fabrics in accordance with the invention can be used in higher temperature applications because a lower melting point binder component is not necessary to bond the fibers to each other. The extended upper use temperatures are desired in high temperature fluid filtration and in fabric reinforced plastics.

The following examples are provided to illustrate various embodiments of the invention and should not be construed as limiting the invention in any way.

EXAMPLES

Example 1 (Comparative)

Separate Homopolymer Matrix and Copolymer Binder Fibers

An area bonded nonwoven was produced using separate PET homopolymer and isophthalic acid (IPA) modified PET copolymer filaments. The spinpack consisted of 120 trilobal holes for homopolymer and 12 round holes for copolymer. Both the copolymer and homopolymer were dried at 140° C. for 5 hours prior to extrusion. The polymer throughput was 1.8 gram/hole/minute for both the homopolymer and copolymer. The melt spun fibers were quenched upon exiting the spinneret and the fibers drawn down to 4 dpf using godet rolls. The conditions are summarized below:

Homopolymer: DuPont 1941 PET homopolymer (0.67 dl/g IV, 260° C. melting point);

Copolymer: DuPont 3946R IPA modified PET copolymer (0.65 dl/g IV, 215° C. melting point);

Homopolymer throughput: 1.8 gram/hole/minute;

Copolymer throughput: 1.8 gram/hole/minute;

% Copolymer: 9%;

Spinning speed: 3,000 yard/minute;

Fiber denier: 4 dpf.

Homopolymer extruder conditions:

Zone 1: 293° C.

Zone 2: 296° C.

Zone 3: 299° C.

Zone 4: 302° C.

Block temperature: 304° C.

Copolymer extruder conditions:

Zone 1: 265° C.

Zone 2: 288° C.

Zone 3: 293° C.

Block temperature: 304° C.

The drawn filaments were dispersed onto a moving wire moving at a speed of 62 ft/minute and treated with steam at 115° C. to hold the web together, so that it could be transferred to the bonder. The web was then subjected to bonding at 220° C. in a through air bonder to produce an area bonded nonwoven. The basis weight of the nonwoven web was 0.8 osy.

Example 2 (Inventive)

Separate Homopolymer Matrix and Homopolymer Binder Filaments

An area bonded nonwoven that is in accordance with the present invention was formed from first and second polymer components that were produced using separate PET homopolymer filaments having different polymer IVs. The spinpack consisted of 120 trilobal holes for the higher IV homopolymer (strength fibers) and 12 round holes for the lower IV homopolymer (binder fibers). Both homopolymers were dried at 140° C. for 5 hours prior to extrusion. The polymer throughput was 1.8 gram/hole/minute for both the PET resins. The melt spun fibers were quenched upon exiting the spinneret and the fibers drawn down to 4 dpf using godet rolls. The conditions are summarized below:

Homopolymer filaments (first polymer component): DuPont 1941 PET homopolymer (0.67 dl/g IV, 260° C. melting temperature);

Homopolymer (second polymer component): Eastman F61HC PET homopolymer (0.61 dl/g IV, 260° C. melting temperature);

First polymer component throughput: 1.8 gram/hole/minute;

Second polymer component throughput: 1.8 gram/hole/minute;

Second polymer component: 9%;

Spinning speed: 3,000 yard/minute;

Fiber denier: 4 dpf.

First polymer component extruder conditions:

Zone 1: 293° C.

Zone 2: 296° C.

Zone 3: 299° C.

Zone 4: 302° C.

Block temperature: 304° C.

Second polymer component extruder conditions:

Zone 1: 296° C.

Zone 2: 299° C.

Zone 3: 302° C.

Block temperature: 304° C.

The drawn filaments were dispersed onto a moving wire moving at a speed of 62 ft/minute and treated with steam at 115° C. to hold the web together, so that it could be transferred to the bonder. The filaments were then bonded to each other at 220° C. to produce an area bonded nonwoven. The basis weight of the nonwoven web was 0.8 osy. Table 1 below compares the properties of the nonwoven fabrics prepared in Examples 1 and 2. The nonwoven webs were tested according to the overall method for textiles ASTM D-1117.

TABLE 1

Physical Properties of Examples 1 and 2

| Property | Example 1 (Comparative) | Example 2 (Inventive) | TEST METHOD |
|---|---|---|---|
| MD Grab Break (lbs) | 16.8 | 14.2 | D-5034 |
| MD Grab Elong. (%) | 40.8 | 60.3 | D-5034 |

TABLE 1-continued

Physical Properties of Examples 1 and 2

| Property | Example 1 (Comparative) | Example 2 (Inventive) | TEST METHOD |
|---|---|---|---|
| MD Grab Mod. (lb/in) | 7.9 | 7.2 | D-5034 |
| XD Grab Break (lbs) | 11.9 | 11.2 | D-5034 |
| XD Grab Elong. (%) | 44 | 67 | D-5034 |
| XD Grab Mod. (lb/in) | 6.2 | 4.9 | D-5034 |
| MD Strip Break (lbs) | 7.2 | 5.8 | D-5035 |
| MD Strip Elong. (%) | 40 | 29 | D-5035 |
| MD Strip Mod. (lb/in) | 4.8 | 4.8 | D-5035 |
| XD Strip Break (lbs) | 2.7 | 2.9 | D-5035 |
| XD Strip Elong. (%) | 32 | 20 | D-5035 |
| XD Strip Mod. (lb/in) | 2.0 | 2.7 | D-5035 |
| MD Trap Tear (lbs) | 5.1 | 9.4 | D-5733 |
| XD Trap Tear (lbs) | 5.5 | 9.3 | D-5733 |
| 170° C. MD Shrink (%) | 2.8 | 0.7 | D-2259 |
| 170° C. XD Shrink (%) | −0.7 | −0.2 | D-2259 |
| AIR Perm (cfm) | 770 | 710 | D-737 |
| Thickness (mils) | 7.5 | 7.5 | D-5729 |
| Basis Weight (osy) | 0.81 | 0.82 | D-2259 |

From Table 1, it can be seen that many of the properties for Example 1 (comparative) and Example 2 (inventive) are similar. The strip tensile were slightly higher for Example 1, however Example 2's trap tears were almost twice that of Example 1.

Figure 7:
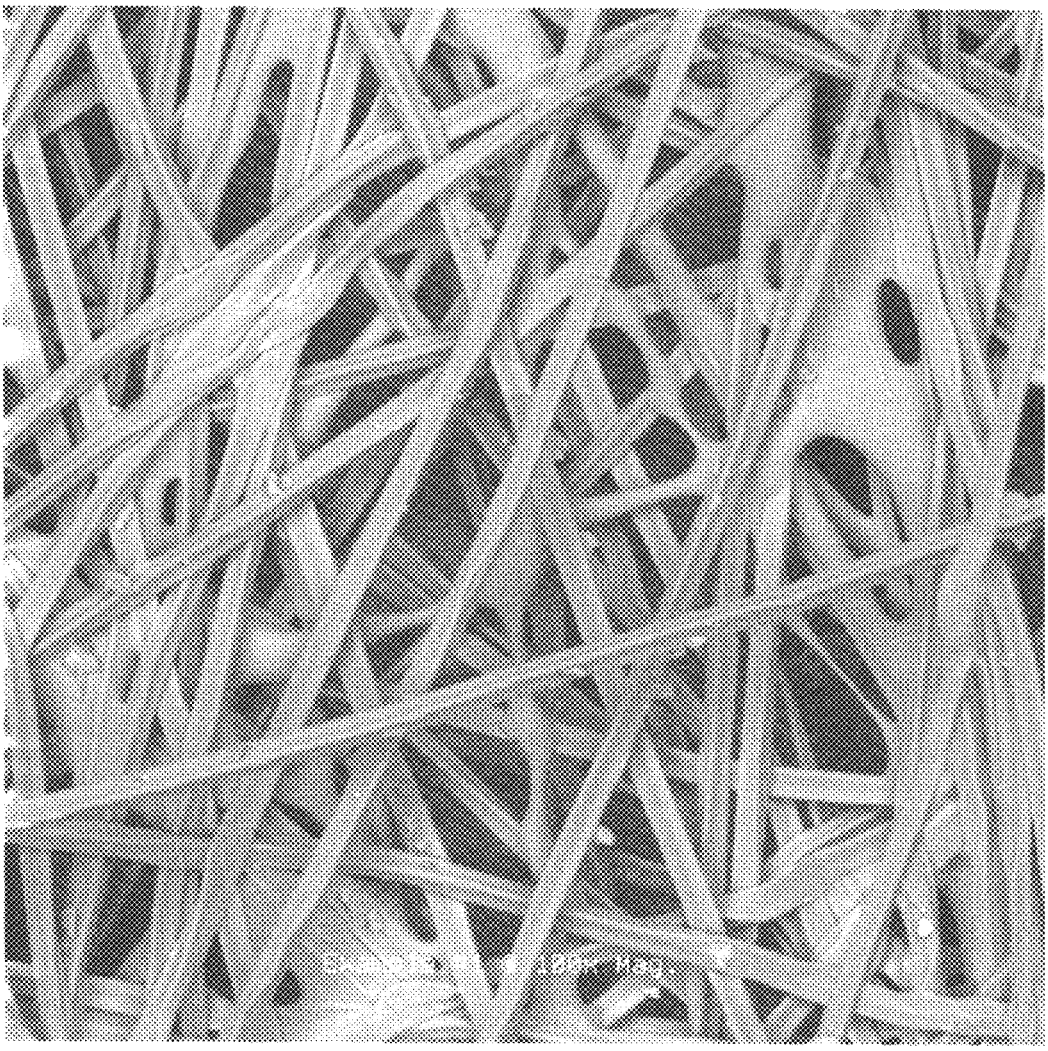
FIG. 7 (PRIOR ART)
FIG. 7 is a SEM photomicrograph of a prior art nonwoven fabric having copolymer binder filaments and homopolymer matrix filaments.
Figure 8:
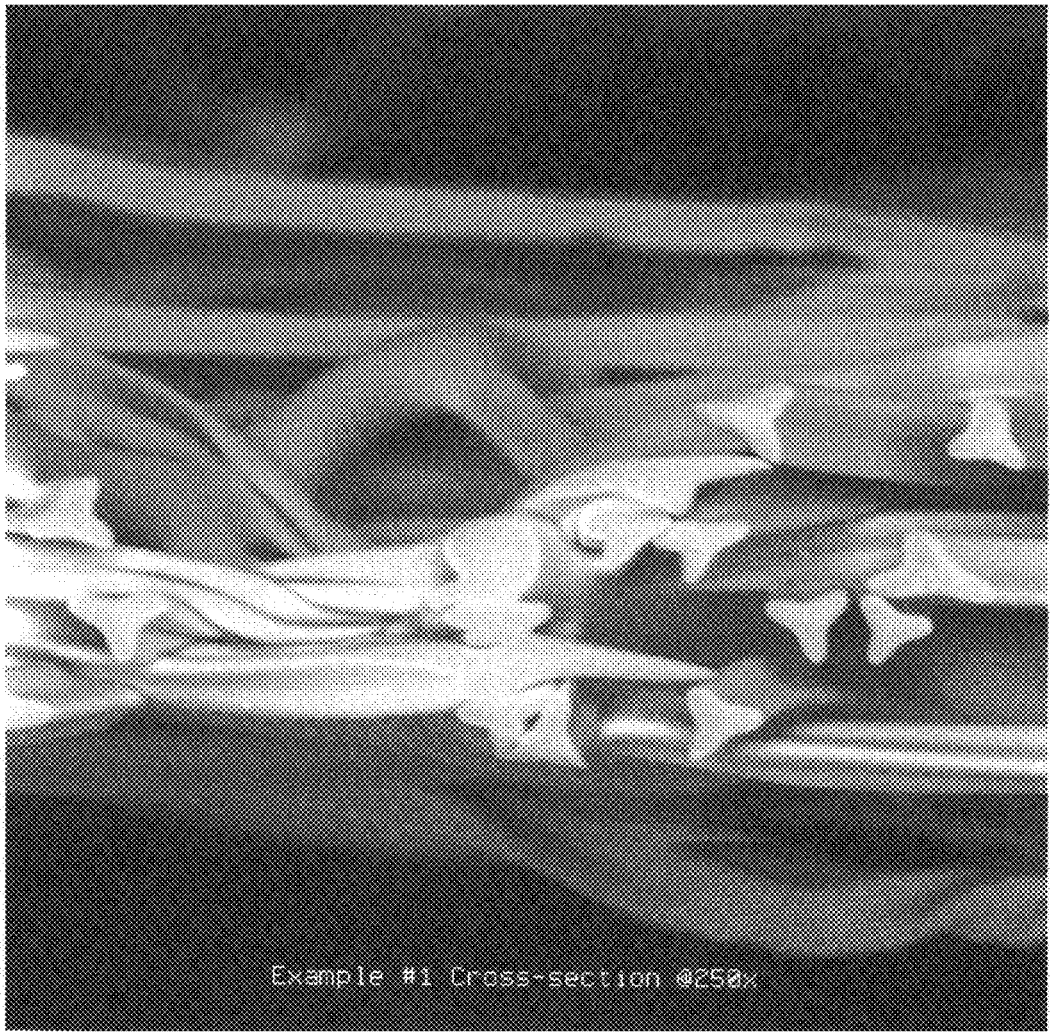
FIG. 8 (PRIOR ART)
FIG. 8 is a cross-sectional side SEM photomicrograph of the nonwoven fabric of FIG. 7.
Figure 9:
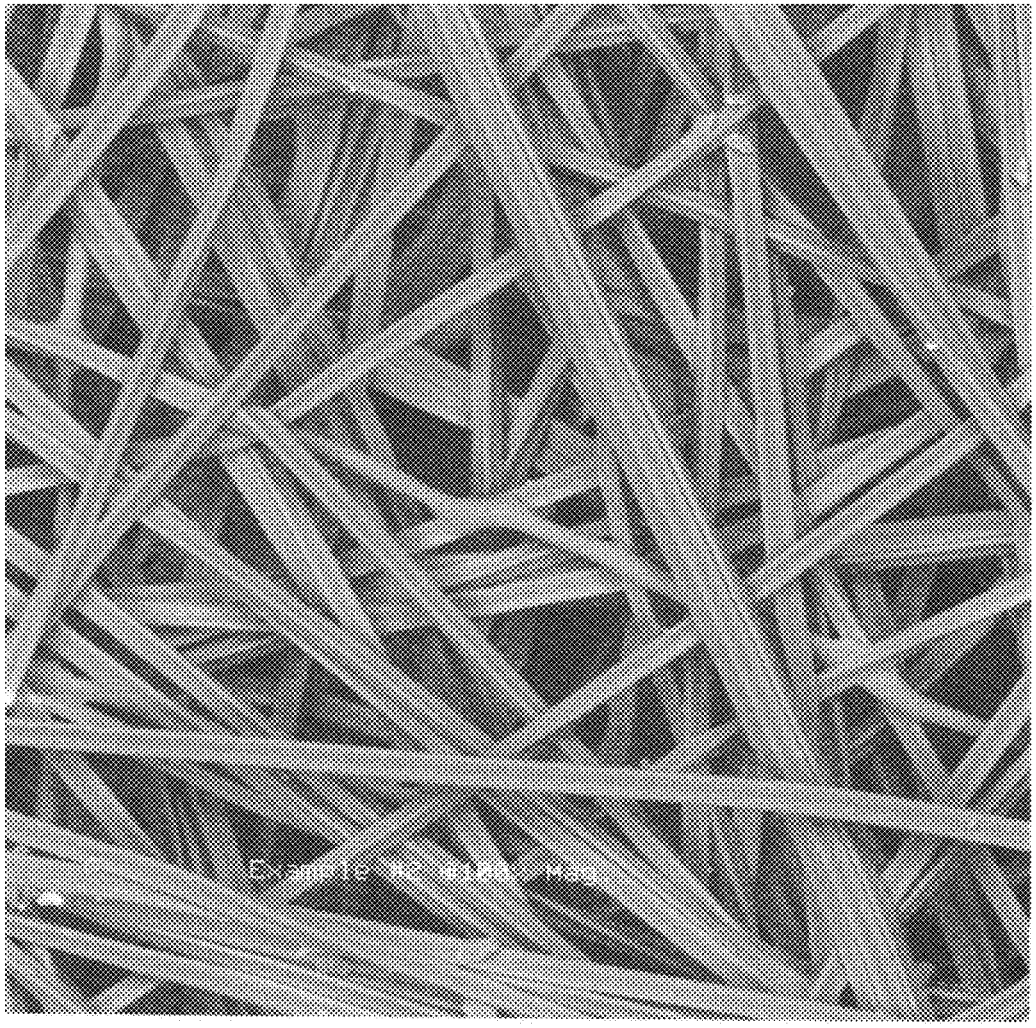
FIG. 9 is a SEM photomicrograph of a nonwoven fabric that is in accordance with the invention in which the fabric includes continuous matrix and binder filaments that are bonded to each other.
Figure 10:
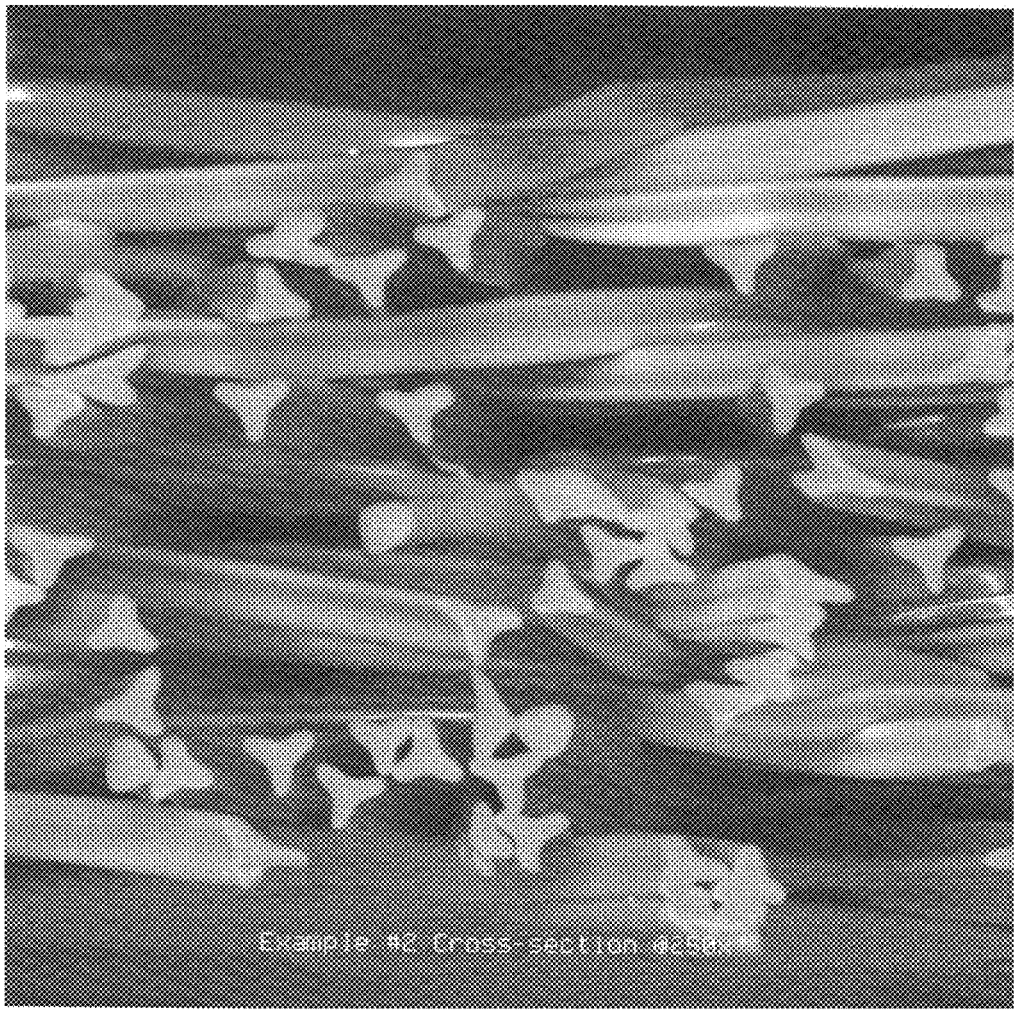
FIG. 10 is a cross-sectional side SEM photomicrograph of the nonwoven fabric of FIG. 9.

FIGS. 7 and 8 are SEM photomicrographs of the nonwoven fabric of Example 1. As can be seen in FIGS. 7 and 8, the copolymer filaments of the fabric have melted and flowed together with the higher melting temperature matrix filaments to thereby bond the matrix filaments together. As a result, in some areas of the fabric the copolymer binder filaments had softened and flowed to the point they no longer have any real discernable structure or filament-like shape. The only filaments that can be readily seen are the higher melting temperature homopolymer filaments. FIGS. 9 and 10 are SEM photomicrographs of the nonwoven fabric of Example 2 (inventive). In contrast to the nonwoven fabric of Example 1, both the binder filaments and the matrix filaments are clearly visible in FIGS. 9 and 10. In particular, the binder filaments have a discernable filament structure that remains intact. The photomicrographs also reveal that the binder filaments have had some deformation around the matrix filaments to bond the binder filaments to the matrix filaments together at points of contact without melting or loss of binder filament structure. In one embodiment, the nonwoven fabric of the invention is characterized by a lack of regions in which the binder filaments have melted and flowed together and around the matrix filaments. In the embodiment in FIGS. 9 and 10, the fabric is further characterized by having a plurality of interconnected continuous filaments in which some of the filaments (binder filaments) have fused to other filaments at points contact and wherein some of the filaments (matrix filaments) have not fused to each other at points of contact, such as when two matrix filaments contact each other. Further, the binder filaments do not appear to form droplets, which are commonly formed in connection with Example 1. Such droplets can be dislodged during subsequent handling, which may lead to particulate contamination.

Figure 11:
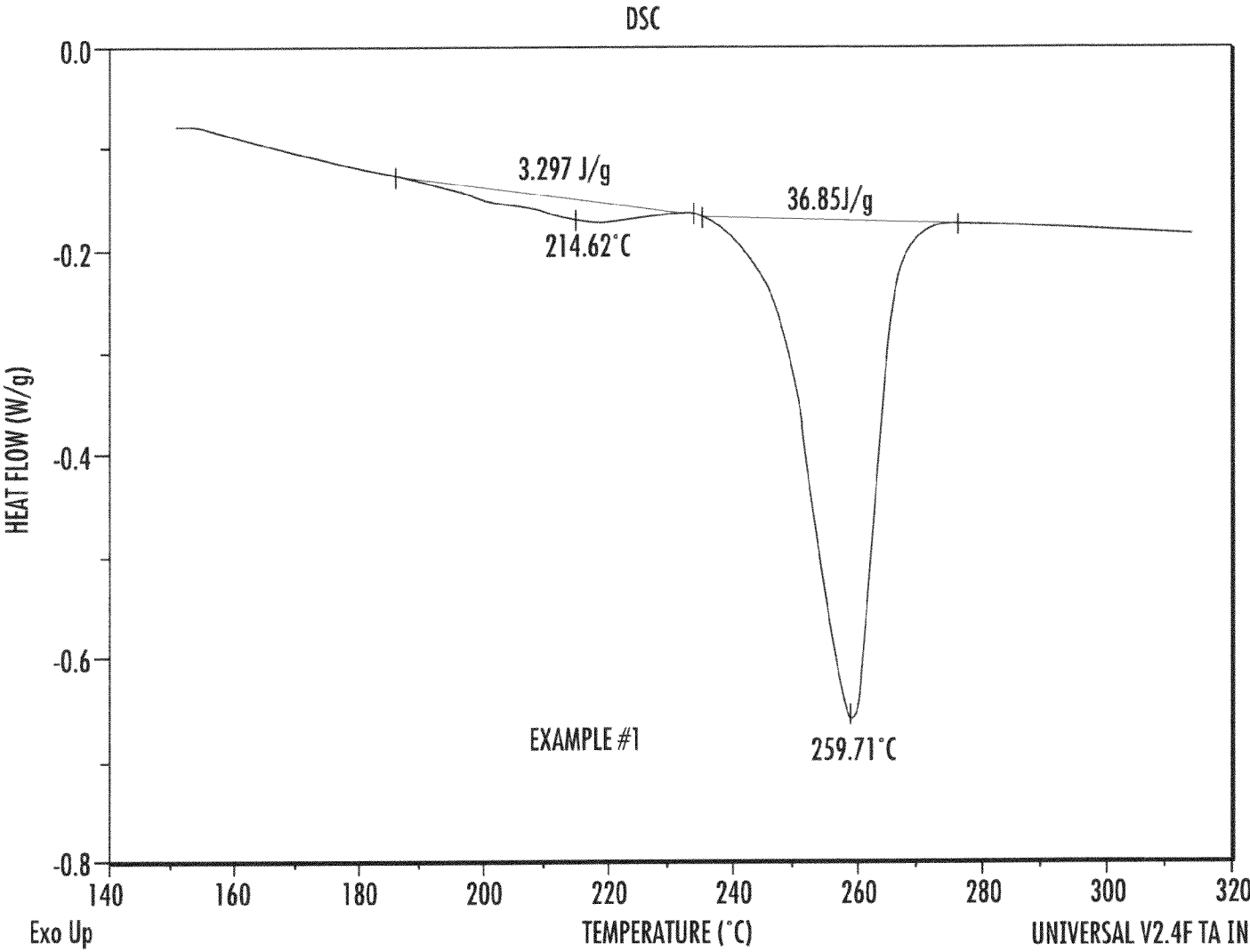
FIG. 11 (PRIOR ART)
FIG. 11 is a differential scanning calorimetry (DSC) trace of the prior art nonwoven fabric of FIG. 7 in which there can be seen distinct melting temperatures for the PET copolymer of the binder filaments and the PET homopolymer of the matrix filaments.
Figure 12:
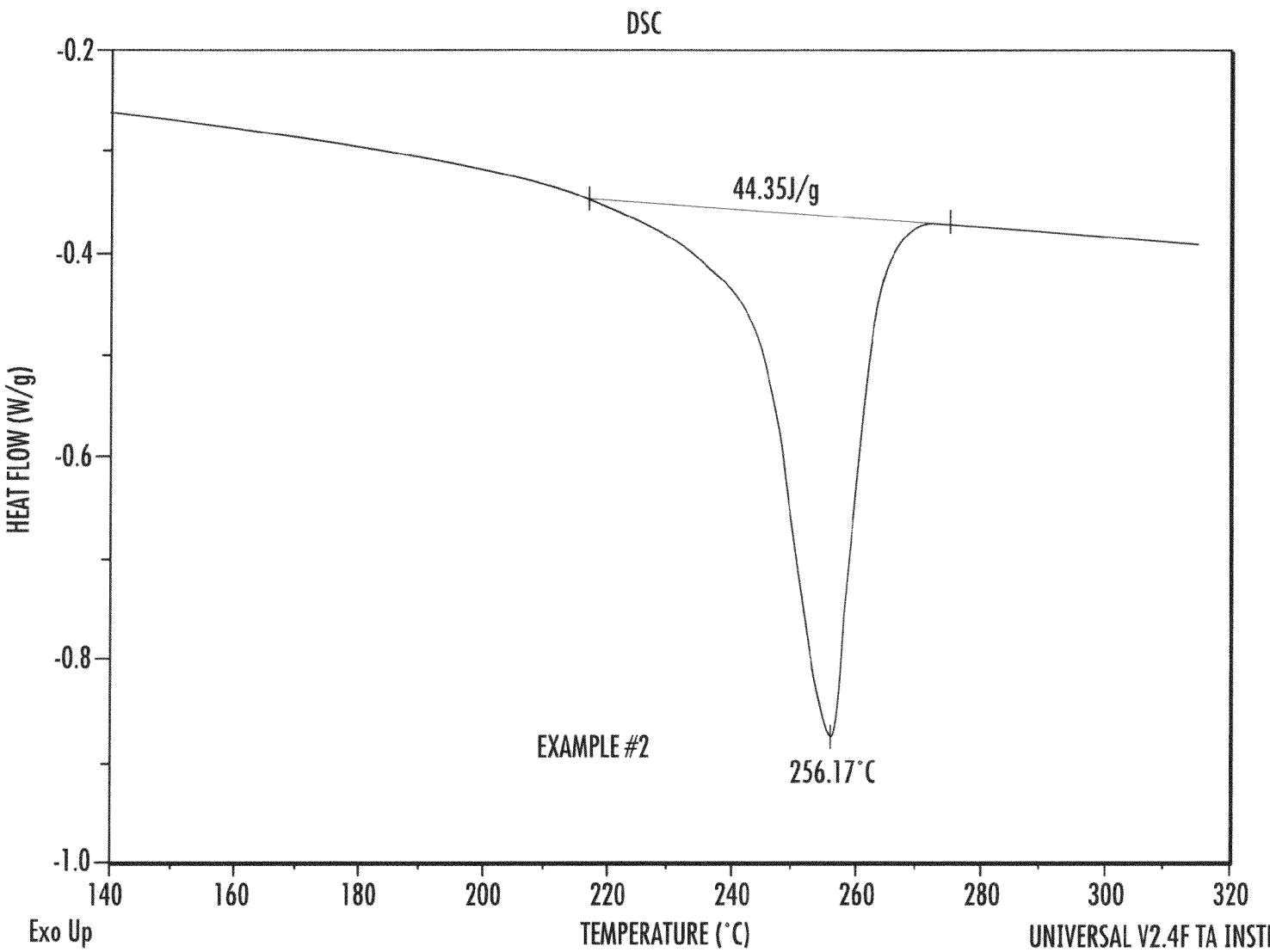
FIG. 12 is a differential scanning calorimetry (DSC) trace of the inventive nonwoven fabric of FIG. 9 in which the DSC trace shows a single melting temperature for the binder and matrix filaments.

FIG. 11 is a differential scanning calorimetry (DSC) trace of the nonwoven fabric of Example 1. The DSC trace clearly shows two distinct inflection points representing two different melting temperatures for the nonwoven fabric of Example 1 (e.g., about 214° C. and about 260° C.). The two melting temperatures is due to the lower melting temperature binder filaments and the higher melting temperature matrix filaments. For example, the copolymer comprising the binder filaments melt around 215° C. while the matrix filaments (homopolymer) melt around 260° C. In contrast, the DSC trace of the nonwoven fabric of Example 2 exhibits only a single melting temperature at 260° C., which is a result of the binder filaments and the matrix filaments both being formed from substantially the same polymer composition, such as PET. Further, since it is not necessary to include a copolymer having a lower melting temperature, as in Example 1, nonwoven fabrics in accordance with the invention can used at higher temperatures. Specifically, the nonwoven fabric of Example 2 can be used at temperatures that are approximately 40° C. higher than the nonwoven fabric of Example 1. DSC was measured according to ASTM E-794 using a Universal V2.4F TA Instrument.

Dyes are commonly used to investigate fiber morphology. The degree of crystallinity, crystallite size, and level of amorphous molecular orientation influences dye uptake. Generally, samples that are less crystalline and have a less oriented amorphous phase accept dye more readily. The two different filaments used to produce Example #2 can be differentiated by dye uptake. Generally, filaments having a darker color have less amorphous orientation, while lighter colored filaments indicate a higher degree of orientation, which is indicative of matrix filaments. Referring to FIGS. 15A and 15B, it can be seen that dyeing results in the matrix filaments having a relatively lighter color in comparison to the binder filaments. As discussed previously, filaments having higher levels or orientation (i.e., matrix filaments) do not take up the dye as readily as the binder filaments and as a result are relatively lighter in color. FIGS. 15A and 15B are photomicrographs of Example 2 taken with a Bausch and Lomb optical microscope equipped with an optical camera. The photomicrograph magnification is 200×. The fabric of FIGS. 15A and 15B comprises a plurality of homofilaments comprising PET that are formed from matrix filaments that are at least partially crystalline and binder filaments were in a substantially amorphous state during thermal bonding.

Example 3 (Comparative)

Sheath/Core Copolymer/Homopolymer Trilobal Bicomponent Fibers

In Example 3, an area bonded nonwoven was produced in a bicomponent fiber configuration. The PET homopolymer was used in the core while the IPA modified PET copolymer was in the sheath. The spinpack consisted of 200 trilobal holes. Both the copolymer and homopolymer were dried at 140° C. for 5 hours prior to extrusion. The polymer throughput was 1.2 gram/hole/minute for the homopolymer core and 0.14 gram/hole/minute for the copolymer sheath so that the resulting fiber was comprised of 10% sheath and 90% core. The melt spun fibers were quenched upon exiting the spinneret and the fibers drawn down to 3 dpf using godet rolls. The conditions are summarized below:

Core: DuPont 1941 PET homopolymer (0.67 dl/g IV, 260° C. melting point);

Sheath: DuPont 3946R IPA modified PET copolymer (0.65 dl/g IV, 215° C. melting point);

Core polymer throughput: 1.2 gram/hole/minute;

Sheath polymer throughput: 0.14 gram/hole/minute;

% Sheath: 10%;

Spinning speed: 3,000 yard/minute;

Fiber denier: 3 dpf.

Core (homopolymer) extruder conditions:

Zone 1: 293° C.

Zone 2: 296° C.

Zone 3: 299° C.

Zone 4: 302° C.

Block temperature: 304° C.

Sheath (copolymer) extruder conditions:

Zone 1: 265° C.

Zone 2: 288° C.

Zone 3: 293° C.

Block temperature: 304° C.

The drawn filaments were dispersed onto a moving wire moving at a speed of 22 ft/minute and treated with heated with steam at 115° C. to hold the web together, so that it could be transferred to the bonder at 220° C. to produce an area bonded nonwoven. The basis weight of the nonwoven web was 2.8 osy.

Example 4 (Inventive)

Sheath/Core Homopolymer/Homopolymer Trilobal Bicomponent Fibers

An area bonded nonwoven was produced in a bicomponent fiber configuration. A higher IV PET homopolymer was used in the core while the lower IV PET homopolymer was in the sheath. The spinpack consisted of 200 trilobal holes. Both homopolymers were dried at 140° C. for 5 hours prior to extrusion. The polymer throughput was 1.2 gram/hole/minute for the core polymer and 0.14 gram/hole/minute for the sheath polymer so that the resulting fiber was comprised of 10% sheath and 90% core. The melt spun fibers were quenched upon exiting the spinneret and the fibers drawn down to 3 dpf using godet rolls. The conditions are summarized below:

Core: DuPont 1941 PET homopolymer (0.67 dl/g IV, 260° C. melting point);

Sheath: Eastman F61HC PET homopolymer (0.61 dl/g IV, 260° C. melting point);

Core polymer throughput: 1.2 gram/hole/minute;

Sheath polymer throughput: 0.14 gram/hole/minute;

% Sheath: 10%;

Spinning speed: 3,000 yard/minute;

Fiber denier: 3 dpf.

Core (homopolymer) extruder conditions:

Zone 1: 293° C.

Zone 2: 296° C.

Zone 3: 299° C.

Zone 4: 302° C.

Block temperature: 304° C.

Sheath (copolymer) extruder conditions:

Zone 1: 296° C.

Zone 2: 299° C.

Zone 3: 302° C.

Block temperature: 304° C.

TABLE 2

Physical Properties of Examples 3 and 4

| Property | Example 3 (Comparative) | Example 4 (Inventive) | TEST METHOD |
|---|---|---|---|
| Air Perm. (cfm) | 83 | 151 | D-737 |
| Basis weight (osy) | 2.8 | 2.7 | D-3776 |
| Thickness (mils) | 17 | 15 | D-5729 |
| Grab Ten. - MD | 161 | 154 | D-5034 |
| Grab Ten - XD | 93 | 86 | D-5034 |
| Elongation - MD | 56 | 68 | D-5034 |
| Elongation - XD | 57 | 63 | D-5034 |

Figure 13:
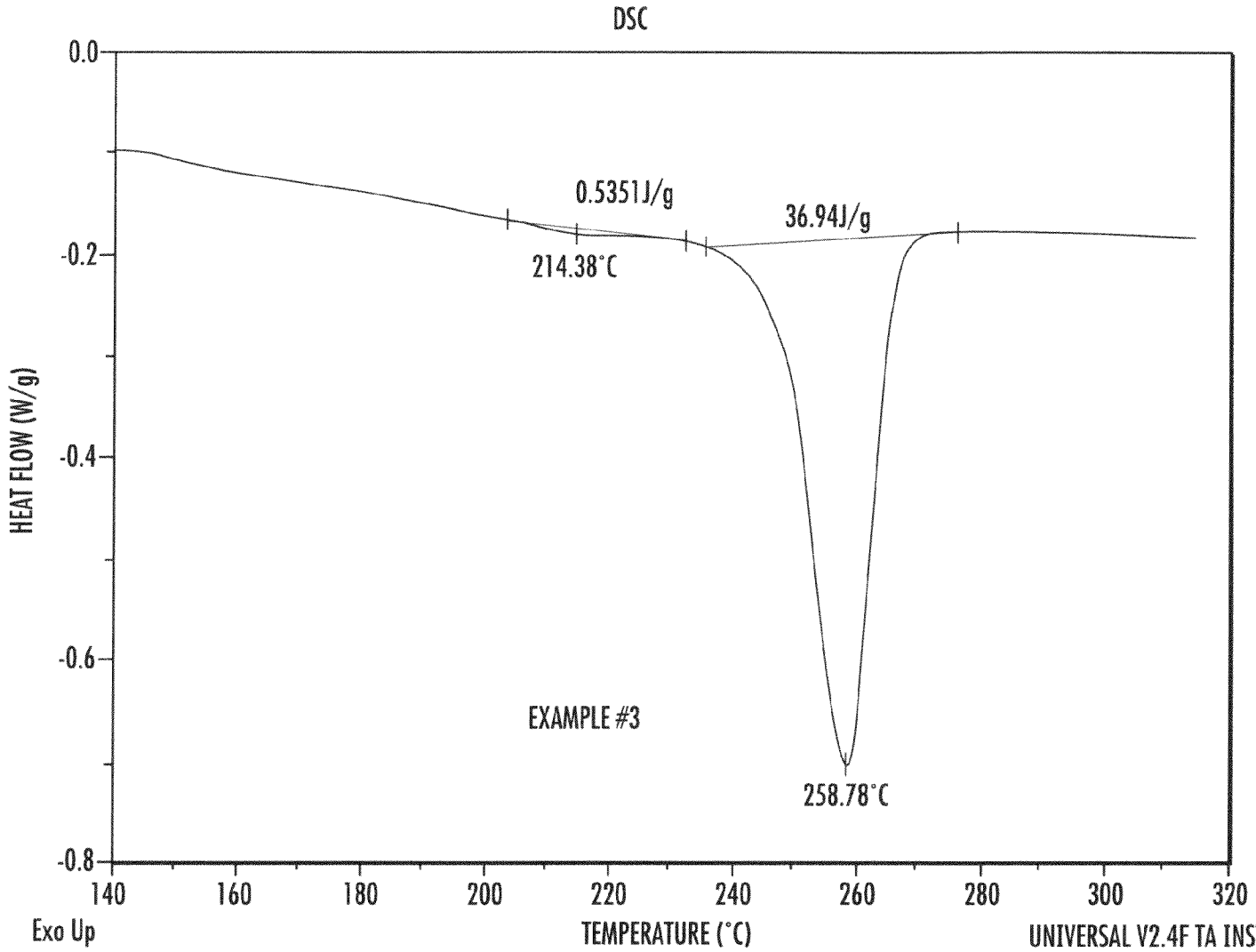
FIG. 13 (PRIOR ART)
FIG. 13 is a differential scanning calorimetry (DSC) trace of a prior art nonwoven fabric having continuous bicomponent filaments in which a PET copolymer forms the binder component and a PET homopolymer forms the matrix component, and in which the DSC trace includes distinct melting temperatures for the binder and homopolymer components.
Figure 14:
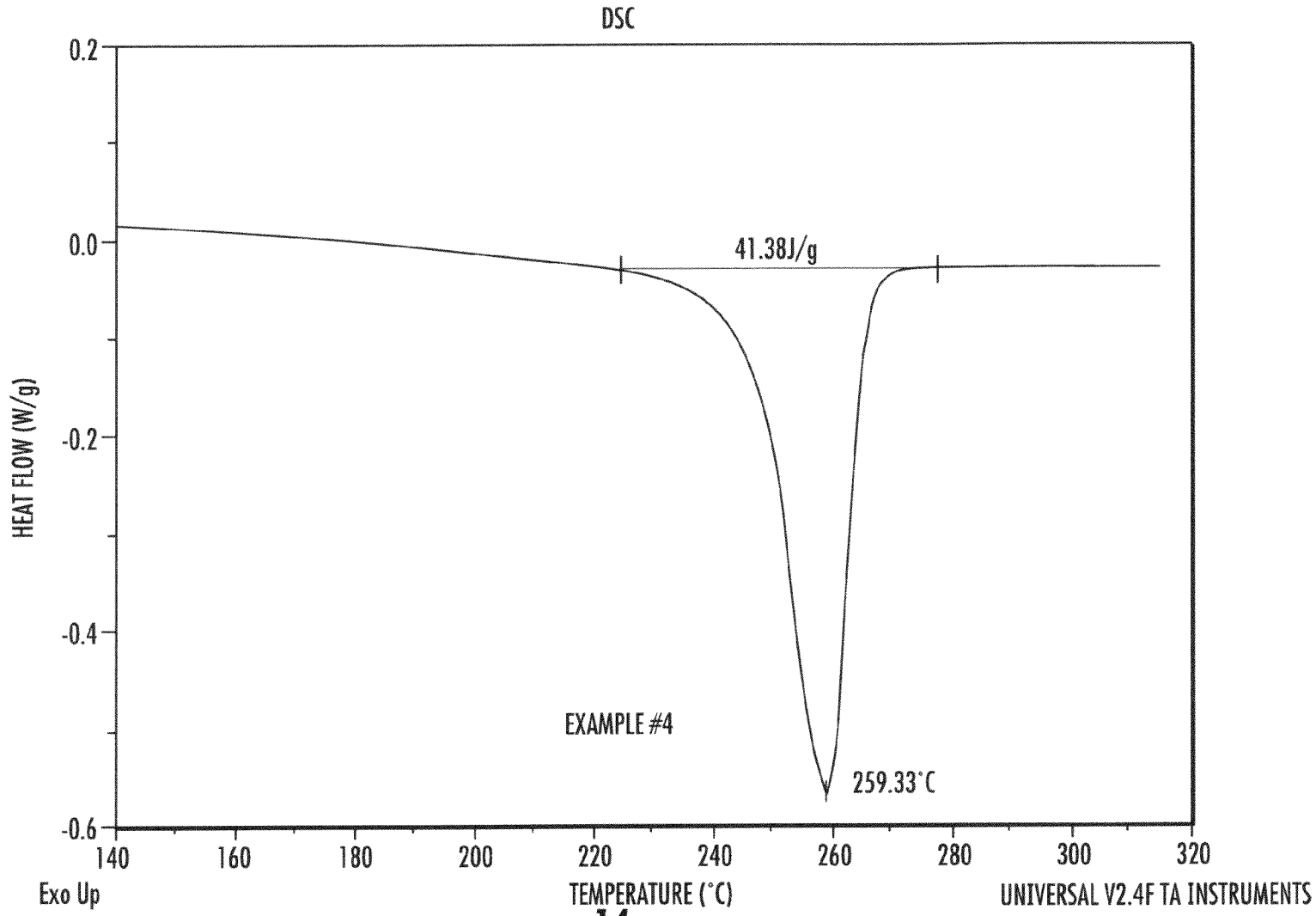
FIG. 14 is a differential scanning calorimetry (DSC) trace of a nonwoven fabric that is in accordance with the invention and comprising continuous bicomponent filaments in which a PET binder component comprises the sheath and a PET matrix component comprises the core, and in which the DSC trace shows a single melting temperature for the binder and matrix components.

Table 2 shows the nonwovens produced in Examples 3 and 4 to have similar physical properties. FIG. 13, which is a DSC trace of Example 3 (comparative), shows two distinct melting temperatures for the nonwoven fabric of Example 3. In Example 3, the binder filaments melt around 215° C. while the matrix filaments melt around 260° C. FIG. 14 is a DSC trace of the nonwoven fabric of Example 4 (inventive). The DSC trace of Example 4 shows only a single melting point at 260° C. As in Examples 1 and 2, the inventive nonwoven fabric of Example 4 can also be used at higher temperatures than the fabric of Example 3.

In the following examples, various spinning speeds and intrinsic viscosities were explored for preparing both binder and matrix filaments comprising PET. The filaments were prepared by extruding filaments through a fiber spinpack, quenching the fibers, drawing the filaments using godet rolls, and laying the fibers down on a collection belt. Fiber samples were then collected for testing. The fiber type was determined by feeding bundles of fibers through a laboratory laminator at 130° C. The binder fibers fused together at 130° C., while the matrix fibers would not bond together at this temperature.

The filaments in Table 3 were prepared from the following polymer compositions:

Samples 1-6: DuPont 1941 PET homopolymer (0.67 dl/g IV, 260° C. melting temperature);

Samples 7-12: Eastman F61HC PET homopolymer (0.61 dl/g IV, 260° C. melting temperature);

Samples 13-18: Eastman F53HC PET homopolymer (0.53 dl/g IV, 260° C. melting temperature).

The relative degree of crystallinity of a polymer that undergoes stress induced crystallization can be estimated experimentally using DSC techniques. In this example, degrees of crystallinity were estimated using a TA Instruments Model 2920 DSC for each of the samples and this value is shown in Table 3. To determine the heat of crystallization of a specimen of the polymer in its amorphous state, samples of the PET polymer were heated to a temperature at least 20° C. above the melting point and then the sample was removed and quenched rapidly using cryogenic freeze spray (Chemtronics Freeze-It). The sample was then allowed to equilibrate to room temperature before heating at 10° C./minute. The sample is assumed to be 100% amorphous and from the area of the DSC curve, the heat of crystallization of amorphous PET was determined to be 31.9 joules/gram.

Next, the degrees of crystallinity of the spun fibers were estimated by heating the fibers at 10° C./minute and measuring the heat of crystallization from the area of the DSC curve. The percent of maximum achievable crystallinity (degree of crystallinity) is calculated by the formula [1−(heat of crystallization for fiber/heat of crystallization for amorphous)]× 100%.

TABLE 3

Heat of fusion and crystallinity data for PET fibers of varying intrinsic viscosity and prepared under varying spinning speeds.

| Sample | Intrinsic Viscosity (dl/g) | Spinning Speed (y/min) | Delta N | Fiber Type | Dye | $T_c$ (° C.) | Delta $H_{cryst}$ | % of max, crystallinity* |
|---|---|---|---|---|---|---|---|---|
| 1 | 0.67 | 1,800 | 0.0081 | Binder | Dark | 126 | 29.4 J/g | 8 |
| 2 | 0.67 | 2,200 | 0.0087 | Binder | Dark | 123 | 27.3 J/g | 14 |
| 3 | 0.67 | 2,600 | 0.0090 | Binder | Dark | 117 | 25.0 J/g | 22 |
| 4 | 0.67 | 3,000 | 0.0079 | Matrix | Lighter | 112 | 18.2 J/g | 43 |
| 5 | 0.67 | 3,400 | 0.0120 | Matrix | Lighter | 109 | 12.4 J/g | 61 |
| 6 | 0.67 | 3,800 | 0.0092 | Matrix | Lighter | 101 | 9.9 J/g | 69 |
| 7 | 0.61 | 1,800 | 0.0089 | Binder | Dark | 123 | 30.9 J/g | 3 |
| 8 | 0.61 | 2,200 | 0.0077 | Binder | Dark | 122 | 26.1 J/g | 18 |
| 9 | 0.61 | 2,600 | 0.0047 | Binder | Dark | 117 | 29.3 J/g | 8 |
| 10 | 0.61 | 3,000 | 0.0065 | Binder | Dark | 115 | 21.2 J/g | 34 |
| 11 | 0.61 | 3,400 | 0.0127 | Binder | Dark | 110 | 21.8 J/g | 32 |
| 12 | 0.61 | 3,800 | 0.0064 | Binder/Matrix | Dark | 108 | 19.4 J/g | 39 |
| 13 | 0.53 | 1,800 | 0.0065 | Binder | Dark | 122 | 28.2 J/g | 12 |
| 14 | 0.53 | 2,200 | 0.0077 | Binder | Dark | 120 | 26.4 J/g | 17 |
| 15 | 0.53 | 2,600 | 0.0089 | Binder | Dark | 116 | 25.4 J/g | 20 |
| 16 | 0.53 | 3,000 | 0.0085 | Binder | Dark | 113 | 27.2 J/g | 15 |
| 17 | 0.53 | 3,400 | 0.0097 | Binder | Dark | 108 | 22.2 J/g | 30 |
| 18 | 0.53 | 3,800 | 0.0101 | Binder | Dark | 107 | 22.2 J/g | 30 |

*% of maximum crystallinity calculated by: Assumes Delta $H_{cryst}$ of totally amorphous PET resin is 31.9 J/g Delta $H_{cryst}$ /31.9 J/g × 100% = % of uncrystallized PET % of Maximum Crystallinity = 100% − % of uncrystallized PET;

$T_c$ is the temperature at which the polymer crystallizes.

Generally, the data in Table 3 indicated that the filaments having a degree of crystallinity of about 35% or greater exhibited properties indicative of matrix filaments, whereas filaments with a degree of crystallinity below this value typically exhibited binder filaments properties. One of the purposes of these examples is to illustrate how variations in the spinning speed influence spinline stress, and in turn, the degree of crystallization of the filaments. These examples were for filaments that were not subjected to bonding conditions. It can also be seen from the data in Table 3 that as the spinning speed for each polymer increases, the temperature for the onset of crystallization decreases.

It should be understood that when the nonwoven fabric is subsequently heated to cause the binder filaments to soften and fuse, additional crystallization will take place, both in the matrix filaments and in the binder filaments. As a result, in the final bonded fabric, the polymer will have a much higher degree of crystallization. In the final product, the degree of crystallinity will be at least 50%, more desirably at least 60%, even more desirably at least 80% of the polymer's maximum achievable crystallinity. Indeed, the degree of crystallinity can be 95% or higher of the polymer's maximum achievable crystallinity.

The data from Table 3 also suggest that filaments having a heat of fusion above about 20 Joules/gram were typically useful as binder fibers and heats of fusion less than 20 Joules/gram were typically matrix fibers.

In Samples 19-32, the binder/matrix characteristics of filaments comprising PLA and PTT were explored. The results are summarized in Table 4 below. The filaments in Table 3 were prepared from the following polymer compositions:

Samples 19-24: Nature Works 6202D polylactic acid (PLA)

Samples 25-32: Shell Corterra 509201 polytrimethylene terephthalate (PTT)

TABLE 4

Heat of fusion and crystallinity data for PLA and PTT fibers

| Sample | Polymer Composition | Spinning Speed (y/min) | $T_c$ (° C.) | Delta $H_{cryst}$ (j/g) | Fiber Type |
|---|---|---|---|---|---|
| 19 | PLA | 1,800 | 94.6 | 21.3 | Binder |
| 20 | PLA | 2,200 | 90.8 | 19.4 | Binder |
| 21 | PLA | 2,600 | 86.9 | 22.3 | Binder |
| 22 | PLA | 3,000 | 81.5 | 22.1 | Strength |
| 23 | PLA | 3,400 | 74.9 | 18.8 | Strength |
| 24 | PLA | 3,800 | 72.2 | 17.0 | Strength |
| 25 | PTT | 800 | 66.6 | 25.0 | Binder |
| 26 | PTT | 1,000 | 67.0 | 25.1 | Binder |
| 27 | PTT | 1,800 | 60.9 | 25.5 | Strength |
| 28 | PTT | 2,200 | 58.1 | 21.6 | Strength |
| 29 | PTT | 2,600 | 57.3 | 20.5 | Strength |
| 30 | PTT | 3,000 | 54.3 | 20.6 | Strength |
| 31 | PTT | 3,400 | 54.8 | 17.3 | Strength |
| 32 | PTT | 3,800 | 52.2 | 15.5 | Strength |

Filaments comprising PLA and having crystallization temperatures higher than about 82° C. generally exhibited properties indicative of binder fibers. For PTT, it appeared that crystallization points higher than 61° C. were indicative of binder fibers.

Example 5 (Comparative)

Separate Homopolymer Matrix and Copolymer Binder Fibers

An area bonded nonwoven was produced using separate PET homopolymer and isophthalic acid (IPA) modified PET copolymer filaments. The melt spun fibers were quenched upon exiting the spinneret and the fibers drawn down to 4 dpf using godet rolls. The conditions are summarized below:

Homopolymer: DuPont 1941 PET homopolymer (0.67 dl/g IV, 260° C. melting point);

Copolymer: DuPont 3946R IPA modified PET copolymer (0.65 dl/g IV, 215° C. melting point);

% Copolymer: 9%;

Spinning speed: 2,500 yard/minute;

Fiber denier: 4 dpf.

Homopolymer extruder conditions:

Zone 1: 250° C.

Zone 2: 260° C.

Zone 3: 270° C.

Zone 4: 270° C.

Zone 5: 270° C.

Zone 6: 270° C.

Block temperature: 270° C.

Copolymer extruder conditions:

Zone 1: 250° C.

Zone 2: 260° C.

Zone 3: 265° C.

Zone 4: 265° C.

Zone 5: 265° C.

Zone 6: 265° C.

Block temperature: 265° C.

The drawn filaments were dispersed onto a moving wire and treated with steam to hold the web together, so that it could be transferred to the bonder. The web was then subjected to bonding at 230° C. in a through air bonder to produce an area bonded nonwoven. The basis weight of the nonwoven web was 0.55 osy.

Example 6 (Inventive)

Separate Homopolymer Matrix and Homopolymer Binder Filaments

An area bonded nonwoven that is in accordance with the present invention was formed from first and second polymer components that were produced using separate PET homopolymer filaments having different polymer IVs. Both homopolymers were dried at 140° C. for 5 hours prior to extrusion. The melt spun fibers were quenched upon exiting the spinneret and the fibers drawn down to 4 dpf using godet rolls. The conditions are summarized below.

Homopolymer filaments (first polymer component): DuPont 1941 PET homopolymer (0.67 dl/g IV, 260° C. melting temperature);

Homopolymer (second polymer component): DuPont 3948 PET homopolymer (0.59 dl/g IV, 260° C. melting temperature);

Second polymer component: 9%;

Spinning speed: 2,500 yard/minute;

Fiber denier: 4 dpf.

Homopolymer extruder conditions:

Zone 1: 250° C.

Zone 2: 260° C.

Zone 3: 270° C.

Zone 4: 270° C.

Zone 5: 270° C. Zone 6: 270° C.

Block temperature: 270° C.

Second polymer component extruder conditions:

Zone 1: 250° C.

Zone 2: 260° C.

Zone 3: 270° C.

Zone 4: 270° C.

Zone 5: 270° C.

Zone 6: 270° C.

Block temperature: 270° C.

The drawn filaments were dispersed onto a moving wire and treated with steam to hold the web together, so that it could be transferred to the bonder. The filaments were then bonded to each other at 230° C. to produce an area bonded nonwoven. The basis weight of the nonwoven web was 0.55 osy. Table 5 below shows that comparative properties were obtained in Examples 5 and 6. The nonwoven webs were tested according to the overall method for textiles ASTM D-1117.

TABLE 5

Physical Properties of Examples 5 and 6

| Property | Example 5 (Comparative) | Example 6 (Inventive) | TEST METHOD |
|---|---|---|---|
| MD Grab Break (lbs) | 11.0 | 10.5 | D-5034 |
| MD Grab Elong. (%) | 54.4 | 56.0 | D-5034 |
| XD Grab Break (lbs) | 7.3 | 7.3 | D-5034 |
| XD Grab Elong. (%) | 48.9 | 47.0 | D-5034 |

TABLE 5-continued

Physical Properties of Examples 5 and 6

| Property | Example 5 (Comparative) | Example 6 (Inventive) | TEST METHOD |
|---|---|---|---|
| MD Strip Break (lbs) | 3.2 | 3.4 | D-5035 |
| XD Strip Break (lbs) | 4.3 | 5.0 | D-5035 |
| 170° C. MD Shrink (%) | 2.7 | 2.5 | D-2259 |
| 170° C. XD Shrink (%) | −1.9 | −1.5 | D-2259 |
| AIR Perm (cfm) | 1470 | 1467 | D-737 |
| Thickness (mils) | 6.9 | 6.7 | D-5729 |
| Basis Weight (osy) | 0.55 | 0.55 | D-2259 |

Example 7 (Comparative)

Separate Homopolymer Matrix and Copolymer Binder Fibers

An area bonded nonwoven was produced using separate PET homopolymer and isophthalic acid (IPA) modified PET copolymer filaments. The melt spun fibers were quenched upon exiting the spinneret and the fibers drawn down to 4 dpf using godet rolls. The conditions are summarized below:

Homopolymer: DuPont 1941 PET homopolymer (0.67 dl/g IV, 260° C. melting point);

Copolymer: DuPont 3946R IPA modified PET copolymer (0.65 dl/g IV, 215° C. melting point);

% Copolymer: 8.5%;

Spinning speed: 2,750 yard/minute;

Fiber denier: 4 dpf.

Homopolymer extruder conditions:

Zone 1: 250° C.

Zone 2: 260° C.

Zone 3: 270° C.

Zone 4: 275° C.

Zone 5: 275° C.

Zone 6: 275° C.

Block temperature: 275° C.

Copolymer extruder conditions:

Zone 1: 250° C.

Zone 2: 260° C.

Zone 3: 265° C.

Zone 4: 265° C.

Zone 5: 265° C.

Block temperature: 265° C.

The drawn filaments were dispersed onto a moving wire and treated with steam to hold the web together so that it could be transferred to the bonder. The web was then subjected to bonding at 230° C. in a through air bonder to produce an area bonded nonwoven. The basis weight of the nonwoven web was 0.56 osy.

Example 8 (Inventive)

Separate Homopolymer Matrix and Homopolymer Binder Filaments

An area bonded nonwoven that is in accordance with the present invention was formed from first and second polymer components that were produced using separate PET homopolymer filaments having different polymer IVs. Both homopolymers were dried at 140° C. for 5 hours prior to extrusion. The melt spun fibers were quenched upon exiting the spinneret and the fibers drawn down to 4 dpf using godet rolls. The conditions are summarized below:

Homopolymer filaments (first polymer component): DuPont 1941 PET homopolymer (0.67 dl/g IV, 260° C. melting temperature);

Homopolymer (second polymer component): DuPont 3948 PET homopolymer (0.59 dl/g IV, 260° C. melting temperature);

Second polymer component: 8.5%;

Spinning speed: 2,750 yard/minute;

Fiber denier: 4 dpf.

Homopolymer extruder conditions:

Zone 1: 250° C.

Zone 2: 260° C.

Zone 3: 270° C.

Zone 4: 270° C.

Zone 5: 270° C.

Zone 6: 270° C.

Block temperature: 270° C.

Second polymer component extruder conditions:

Zone 1: 250° C.

Zone 2: 260° C.

Zone 3: 270° C.

Zone 4: 270° C.

Zone 5: 270° C.

Zone 6: 270° C.

Block temperature: 270° C.

The drawn filaments were dispersed onto a moving wire and treated with steam to hold the web together, so that it could be transferred to the bonder. The filaments were then bonded to each other at 230° C. to produce an area bonded nonwoven. The basis weight of the nonwoven web was 0.56 osy. Table 6 below compares the properties of the nonwoven fabrics prepared in Examples 7 and 8. The nonwoven webs were tested according to the overall method for textiles ASTM D-1117.

TABLE 6

Physical Properties of Examples 7 and 8

| Property | Example 7 (Comparative) | Example 8 (Inventive) | TEST METHOD |
|---|---|---|---|
| MD Grab Break (lbs) | 12.0 | 12.1 | D-5034 |
| MD Grab Elong. (%) | 38.7 | 38.9 | D-5034 |
| XD Grab Break (lbs) | 4.0 | 4.2 | D-5034 |
| XD Grab Elong. (%) | 48.3 | 48.7 | D-5034 |
| MD Strip Break (lbs) | 1.8 | 2.2 | D-5035 |
| XD Strip Break (lbs) | 4.6 | 5.8 | D-5035 |
| 170° C. MD Shrink (%) | 0.7 | 0.4 | D-2259 |
| 170° C. XD Shrink (%) | 0 | −0.3 | D-2259 |
| AIR Perm (cfm) | 1395 | 1357 | D-737 |
| Thickness (mils) | 6.1 | 6.1 | D-5729 |
| Basis Weight (osy) | 0.56 | 0.56 | D-2259 |

From Table 6, it can be seen that many of the properties for Example 1 (comparative) and Example 2 (inventive) are similar.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of making an area-bonded nonwoven fabric comprising the steps of:

melt extruding a crystallizable amorphous polymer of a single polymer system to produce a plurality of fibers;

subjecting the polymer to processing conditions that produce a first polymer component that is at least partially crystalline and a second polymer component that is substantially amorphous;

depositing the plurality of fibers on a collection surface to form a web containing both said first polymer component and said second polymer component;

bonding at least some of the plurality of fibers to one another at adjacent points of contact to form an area bonded nonwoven web in which the second polymer component softens and fuses to form bonds with the first polymer component; and effecting crystallization of the second polymer component so that in the resulting nonwoven fabric both said polymer components are at least partially crystalline;

wherein the second polymer component is present in an amount ranging from 2% to 35% by weight, and wherein the processing conditions are selected from the group consisting of (a) subjecting fibers of the first polymer component to stress that induces crystallization, and subjecting fibers of the second polymer component to stress insufficient to induce crystallization, wherein the steps of subjecting the first and second polymer components to stress to induce or not induce crystallization comprises extruding the fibers at differing extrusion rates; and (b) subjecting fibers of the first polymer component to stress that induces crystallization, and subjecting fibers of the second polymer component to stress insufficient to induce crystallization, wherein the steps of subjecting the first and second polymer components to stress to induce or not induce crystallization comprises providing a reduction in the intrinsic viscosity of the polymer in the second polymer component relative to the intrinsic viscosity of the polymer in the first polymer component.

2. The method of claim 1, wherein the crystallizable polymer is selected from the group consisting of polyethylene terephthalate, polytrimethylene terephthalate, polybutylene terephthalate, and polylactic acid, and copolymers and combinations thereof.

3. The method of claim 1, wherein the second polymer component prior to bonding has a softening temperature that is at least 5° C. less than a softening temperature of the first polymer component.

4. The method of claim 1, wherein the step of bonding the fibers comprises heating the fibers to a temperature at which the second polymer component softens and becomes tacky while the first polymer component remains solid, maintaining the fibers in the form of a web while the softened second polymer component adheres to portions of other fibers at fiber crossover points, and cooling the fibers to solidify the second polymer component and form a bonded nonwoven web.

5. The method of claim 1, wherein the fibers of the nonwoven fabric exhibit a single melting peak as evidenced by a differential scanning calorimetry (DSC) trace.

6. The method of claim 1, wherein the step of melt extruding comprises melt extruding the polymer through one or more spinnerets that form first and second groups of continuous filaments, and said step of subjecting the polymer to processing conditions that produce first and second polymer components comprises subjecting the first group of continuous filaments to stress that induces crystallization, and subjecting the second group of continuous filaments to stress insufficient to induce crystallization.

7. The method of claim 6, wherein the steps of subjecting the first and second groups of filaments to stress to induce or not induce crystallization comprises drawing the filaments under differing draw rates.

8. The method of claim 6, wherein the steps of subjecting the first and second groups of filaments to stress to induce or not induce crystallization comprises extruding the filaments at differing extrusion rates.

9. The method of claim 6, wherein the step of extruding a crystallizable polymer comprising extruding said polymer from first and second extruders, and wherein said step of subjecting the polymer to processing conditions that produce first and second polymer components comprises providing a reduction in the intrinsic viscosity of the polymer in the second extruder relative to the intrinsic viscosity of the polymer in the first extruder.

10. The method of claim 9, wherein the intrinsic viscosity of the polymer in the second extruder is lowered by adding a viscosity lowering compound to the polymer in the second extruder.

11. The method of claim 9, wherein the intrinsic viscosity of the polymer in the second extruder is lowered by adding recycled polymer to the second extruder.

12. The method of claim 9, wherein the step of melt extruding a crystallizable amorphous polymer to produce a plurality of fibers comprises melt extruding the polymer through one or more spinnerets configured to form bicomponent filaments with the first and second polymer components present in distinct portions of the cross section of the filament, wherein the second polymer component is present in an amount ranging from 2% to 25% by weight of the bicomponent filaments.

13. The method of claim 12, wherein the spinnerets are configured to form continuous multilobal filaments with the second polymer component present in at least some of the lobes of the filaments.

14. A method of making an area bonded nonwoven fabric comprising the steps of:

melt extruding a crystallizable amorphous polymer of a single polymer system through one or more spinnerets that form first and second groups of continuous filaments;

subjecting the first and second groups of continuous filaments to processing conditions that impart stress to the first group of filaments producing stress-induced crystallization such that the filaments are at least partially crystallized, and impart stress to the second group of continuous filaments insufficient to produce stress-induced crystallization such that the filaments remain substantially amorphous;

depositing the first and second groups of continuous filaments on a collection surface to form a web containing both said partially crystalline first filaments as matrix filaments and said amorphous second filaments as binder filaments;

heating the web so that the binder filaments soften and fuse to form bonds with one another and with the matrix filaments while maintaining their continuous filamentary form; and effecting crystallization of the binder filament during the heating step so that in the resulting nonwoven fabric both said matrix filaments and said binder filaments are at least partially crystalline;

wherein the binder filaments are present in an amount ranging from 5% to 35% by weight, and wherein the processing conditions are selected from the group consisting of a) subjecting continuous filaments of the first group to stress that induces crystallization, and subjecting continuous filaments of the second group to stress insufficient to induce crystallization, wherein the steps of subjecting the continuous filaments of the first group and continuous filaments of the second group to stress to induce or not induce crystallization comprises extruding the continuous filaments at differing extrusion rates; and b) subjecting continuous filaments of the first group to stress that induces crystallization, and subjecting continuous filaments of the second group to stress insufficient to induce crystallization, wherein the steps of subjecting the continuous filaments of the first group and continuous filaments of the second group to stress to induce or not induce crystallization comprises providing a reduction in the intrinsic viscosity of the continuous filaments of the first group relative to the intrinsic viscosity of the continuous filaments of the second group.

15. The method of claim 14, wherein the crystallizable amorphous polymer comprises polyethylene terephthalate.

16. The method of claim 14, wherein the filaments of the nonwoven fabric exhibit a single melting peak as evidenced by a differential scanning calorimetry (DSC) trace.

17. A method of making a nonwoven fabric comprising the steps of:

melt extruding a crystallizable amorphous polymer of a single polymer system through one or more spinnerets configured to form bicomponent filaments having first and second polymer components present in distinct portions of the cross section of the filament, wherein the intrinsic viscosity of the polymer in the second component is reduced relative to the intrinsic viscosity of the polymer in the first component;

attenuating the filaments to cause stress-induced crystallization in the first polymer component of the filaments but without producing stress-induced crystallization in the second polymer component such that the second polymer component remains substantially amorphous;

depositing the bicomponent filaments on a collection surface to form a web in which the first polymer component of the filaments is partially crystalline and serves as the matrix component of the filaments and the second polymer component of the filament is amorphous and serves as the binder component of the filaments;

heating the web so that the binder component of the filaments softens and fuses to form bonds with contacting filaments while the filaments maintain their continuous filamentary form; and effecting crystallization of the binder component of the filaments during the heating step so that in the resulting nonwoven fabric both the matrix component and the binder component of the bicomponent filaments are at least partially crystalline;

wherein the binder component is present in an amount ranging from 2% to 25% by weight.

18. The method of claim 17, including providing the first and second polymer components of differing intrinsic viscosity from two separate sources.

19. The method of claim 17, including providing the first and second polymer components of from the same source and lowering the intrinsic viscosity of the second polymer component by introducing a viscosity lowering additive.

* * * * *